US005638548A

United States Patent [19]

Kawakami

[11] Patent Number: 5,638,548

[45] Date of Patent: Jun. 17, 1997

[54] WRIST RESTRAINER AND WRIST RESTRAINING GLOVE

[75] Inventor: Hisatomi Kawakami, Tokyo, Japan

[73] Assignee: Tetsuhiro Kawakami, Tokyo, Japan

[21] Appl. No.: 720,315

[22] Filed: Sep. 27, 1996

Related U.S. Application Data

[63] Continuation of Ser. No. 345,308, Nov. 28, 1994, abandoned.

[30] Foreign Application Priority Data

| | | | |
|---|---|---|---|
| Dec. 14, 1993 | [JP] | Japan | 5-342502 |
| Mar. 14, 1994 | [JP] | Japan | 6-068996 |
| May 10, 1994 | [JP] | Japan | 6-120599 |
| Jul. 13, 1994 | [JP] | Japan | 6-183946 |
| Jul. 13, 1994 | [JP] | Japan | 6-183947 |

[51] Int. Cl.[6] ..... A41D 19/00

[52] U.S. Cl. ..... 2/161.1; 2/161.2; 2/162; 473/205; 473/212

[58] Field of Search ..... 2/159, 160, 161.1, 2/161.2, 162, 170, 161.3; 482/44, 47, 49; 473/205, 212, 213

[56] References Cited

U.S. PATENT DOCUMENTS

| | | | |
|---|---|---|---|
| 2,154,197 | 4/1939 | Callaway | 2/159 |
| 3,124,806 | 3/1964 | Campbell | 2/160 |
| 3,152,337 | 10/1964 | Barry | 2/161.1 |
| 3,228,035 | 1/1966 | Davis | 2/161 |
| 3,347,547 | 10/1967 | Hynes | 482/47 |
| 3,588,917 | 6/1971 | Antonious | 2/161 |
| 3,606,342 | 9/1971 | Albertson | 273/189 R |
| 3,606,343 | 9/1971 | Lemon | 273/189 R |
| 3,944,220 | 3/1976 | Fasano | 2/159 |
| 4,040,632 | 8/1977 | Pawl | 273/189 A |
| 4,047,250 | 9/1977 | Norman | 2/161 A |
| 4,051,553 | 10/1977 | Howard | 2/161.1 |
| 4,146,935 | 4/1979 | Hinton | 2/161.3 |
| 4,164,043 | 8/1979 | Fujita | 2/161.1 |
| 4,190,906 | 3/1980 | Patton, Jr. | 2/162 |
| 4,502,688 | 3/1985 | Papp | 273/189 A |
| 4,531,241 | 7/1985 | Berger | 2/161.2 |
| 5,027,439 | 7/1991 | Spector | 2/161 A |
| 5,373,585 | 12/1994 | Wiggins | 2/159 |
| 5,453,064 | 9/1995 | Williams, Jr. | 482/47 |
| 5,492,331 | 2/1996 | Kawakami | 2/161.2 |
| 5,514,052 | 5/1996 | Charles et al. | 482/47 |
| 5,527,244 | 6/1996 | Waller et al. | 482/47 |
| 5,538,488 | 7/1996 | Villepigue | 482/47 |

FOREIGN PATENT DOCUMENTS

| | | | |
|---|---|---|---|
| 441585 | 8/1991 | European Pat. Off. . | |
| 2308245 | 9/1974 | Germany | 2/161.1 |
| 2237726 | 5/1991 | United Kingdom | 2/159 |

*Primary Examiner*—Michael A. Neas
*Attorney, Agent, or Firm*—Robert W. J. Usher

[57] ABSTRACT

A wrist restraining glove(110) comprises a hand receiving portion(111) for receiving a hand(H), a wrist band(113) integrally joined to the hand receiving portion(111), and a tension member(115) integrally joined on the palmar surface of at least the hand receiving portion(111). When the glove is worn on the hand, the wrist band(113) is wrapped around a wrist. The tension member(115) exerts a tensile force when pulled longitudinally, thereby an outward pivotal movement of the hand about the wrist can be suppressed.

26 Claims, 27 Drawing Sheets

PRIOR ART

WRIST RESTRAINER AND WRIST RESTRAINING GLOVE

This is a continuation of Ser. No. 03/345,308 filed Nov. 25, 1994, now abandoned.

BACKGROUND OF THE INVENTION

1. Field of the Invention

The present invention relates to a wrist restrainer and a wrist restraining glove which are suitable for golfing and by which an unnecessary pivotal movement of the wrist can be suppressed to enable an accurate and powerful swing of a golf club.

The present invention also relates to a wrist restrainer and a wrist restraining glove which are also suitable for sports such as baseball, tennis and by which an unnecessary pivotal movement of the wrist can be suppressed to reduce arm fatigue.

The present invention further relates to a wrist restrainer and a wrist restraining glove which are suitable for driving and physical working to reduce arm fatigue.

2. Related Prior Arts

It is well-known that pivotal movement of the hand about the wrist during a swing of a golf club greatly influences a direction and speed of a ball hit by the club. For example as shown in FIG. 37A–37B, during a swing of a golf club 1, the pivotal movement of a hand 50 about a wrist 53 within a plane parallel to a back 51 of the hand 50 (the pivotal movement as shown by an arrow "X" in FIG. 37A, which is called as "a cocking pivotal movement" in a golf swing) is effective for making a powerful swing to increase a speed of a ball hit by a club without varying a direction of flight of the ball.

However, the pivotal movement of the hand 50 about the wrist 53 to the direction perpendicular to the back 51 of the hand 50 (the pivotal movement as shown by a arrow "Y" in FIG. 37B) is undesirable because it results in a decreased speed of the ball and incorrect direction of flight.

In particular, it is desirable during a swing of a golf club to permit or induce the pivotal movement of the hand 51 about the wrist within the plane parallel to the back 51 of the hand 50, but it is desirable to suppress the pivotal movement of the hand 50 about the wrist 53 in a direction perpendicular to the back 51 of the hand 50 (movement in an outer direction perpendicular to the back 51).

However, it is quite natural for a human hand to be moved in an outer direction perpendicular to the back of the hand about the wrist (i.e. to move toward the direction "Y" as shown in FIG. 37B). It is rather unnatural to move the hand within the plane parallel to the back of the hand (i.e. to move toward the direction "X" as shown in FIG. 37A). Accordingly, for an amateur or untrained golf player, the hand tends to be moved outward during a swing of a golf club resulting in a decreased speed and in an incorrect direction of flight of the ball hit by the club.

The similar tendency in hand movement occurs not only in golfing but in other sports such as baseball and tennis.

It is considered that the speed and direction of the ball can be greatly improved if the outward pivotal movement of the hand (the outward pivotal movement "Y" as shown in FIG. 37B) is suppressed without suppressing the pivotal movement of the hand within the plane parallel to the back of the hand (the sideward pivotal movement "X" as shown in FIG. 37A).

Further, it is also considered that fatigue of the wrist and the hand can be decreased if the outward pivotal movement of the hand is suppressed in driving (operating of a steering wheel) and in physical works (such as digging earth by a shovel).

SUMMARY OF THE INVENTION

It is an object of the invention to provide a wrist restrainer and a wrist restraining glove which are suitable for golfing and by which an unnecessary pivotal movement of the wrist can be suppressed to enable an accurate and powerful swing of a golf club.

It is another object of the invention to provide a wrist restrainer and a wrist restraining glove which are suitable for the other sports such as baseball, tennis,etc. and by which an unnecessary pivotal movement of the wrist can be suppressed to reduce arm fatigue.

It is a further object of the invention to provide a wrist restrainer and a wrist restraining glove which are suitable for driving and physical work and are effective in reducing arm fatigue.

A wrist restraining glove according to the present invention comprises a hand receiving portion for receiving a hand, a wristlet or wrist band integrally joined to the hand receiving portion, and a tension member integrally joined on the palmar surface of at least the hand receiving portion. When the glove is worn on the hand, the wrist band is wrapped around a wrist. The tension member exerts a tensile force when pulled longitudinally, thereby an outward pivotal movement of the hand about the wrist can be suppressed.

The hand receiving portion can be fingerless and include an annular, palm receiving portion from which wearer's fingers extend in exposed condition.

Further, a flap member may be provided on the back of the hand receiving portion. The flap member is pivotable away from and toward the back of the hand to open and to fasten a longitudinal cut-out formed on the back of the hand receiving portion.

Another wrist restraining glove comprises a hand receiving portion for receiving a hand, a wristlet integrally joined to the hand receiving portion, a tension member integrally joined on the palmar surface of the glove, and a flap member provided on the back of both the hand receiving portion and the wristlet. The flap member is pivotable away from and toward the back of the hand to open and to fasten a longitudinal cut-out formed longitudinally on the back of the hand receiving portion and the wristlet. The tension member exerts a tensile force when pulled longitudinally, whereby an outward pivotal movement of the hand about the wrist can be suppressed.

An envelope-shape inner space or pocket can be formed in the flap member. A resilient restraining plate made of resilient material is loosely inserted therein to suppress an outward pivotal movement of the hand about a wrist. A notch can be formed in the middle of the flap member to positively permit a lateral pivotal movement of the hand about the wrist.

A resilient restraining plate may be integrally joined to the outer surface of the flap member. The restraining plate has a greater resistance to bending in an outward direction than to bending in a lateral direction, perpendicular to the outward direction. The restraining plate may have a gourd-shape configuration comprising a narrow medial portion interconnecting respective wide portions thereof adjacent the wrist and fingers. The medial narrow portion may be thicker than the portions adjacent the wrist and fingers.

A different wrist restraining glove according to the present invention comprises a hand receiving portion, a wrist band member integrally joined to the hand receiving portion, and a tension member integrally joined on the palmar surface of the wrist band member to exert tensile forces. The wrist band member is formed so as to be bent toward a knuckle-end at the palmar side, thereby the hand receiving portion will be pulled inward when the glove is worn on the hand.

A further wrist restraining glove comprises a hand receiving portion, a wristlet integrally joined to the hand receiving portion, and a cut-out laterally formed between the hand receiving portion and the wrist band member on the palmar side. The cut-out is sewed together, thereby the hand receiving portion will be pulled inward when the glove is worn on the hand.

A tension member can be provided in the cutout to exert an inward tensile force against an inward pivotal movement of the hand about the wrist.

Another wrist restraining glove comprises a hand receiving portion, a wristlet integrally joined to the hand receiving portion, and means to pull the hand receiving portion inward with respect to the wristlet.

The means may include a zip fastener provided laterally between the hand receiving portion and the wrist band member on the palmar side, thereby the hand receiving portion is pulled inward when the zip fastener is closed.

The means may include a hook and loop type fastener provided between the hand receiving portion and the wrist band member on the palmar side. The hand receiving portion is pulled inward when the hook and loop type fastener is closed.

A wrist restrainer according to the present invention comprises a band member for wrapping around a wrist, a finger retaining member, a palmar member connecting the band member to the retaining member on the palmar side, and a tension member integrally joined on the palmar member to exert a tensile force against outward pivotal movement of the hand about the wrist.

DETAILED DESCRIPTION OF THE PREFERRED EMBODIMENTS

Figure 1:
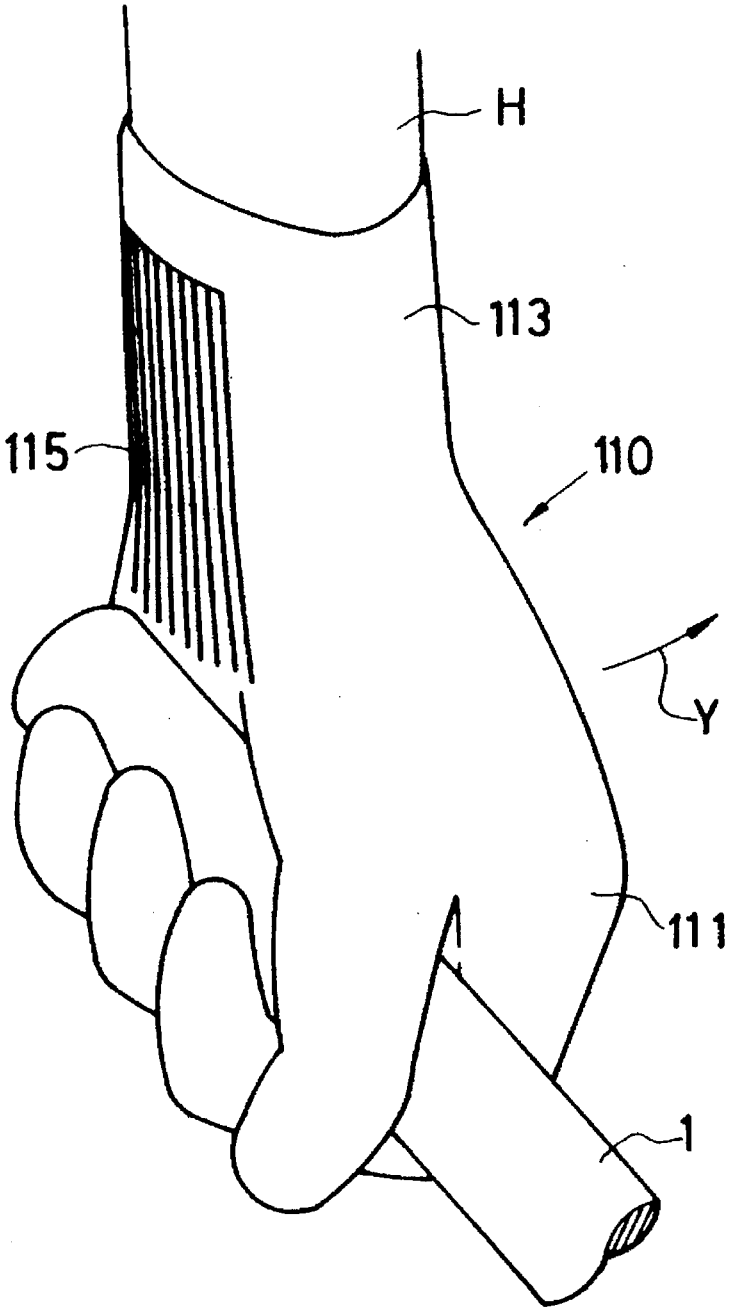
FIG. 1 is a perspective view of a wrist restraining glove according to the present invention which is worn on a hand.
Figure 2:
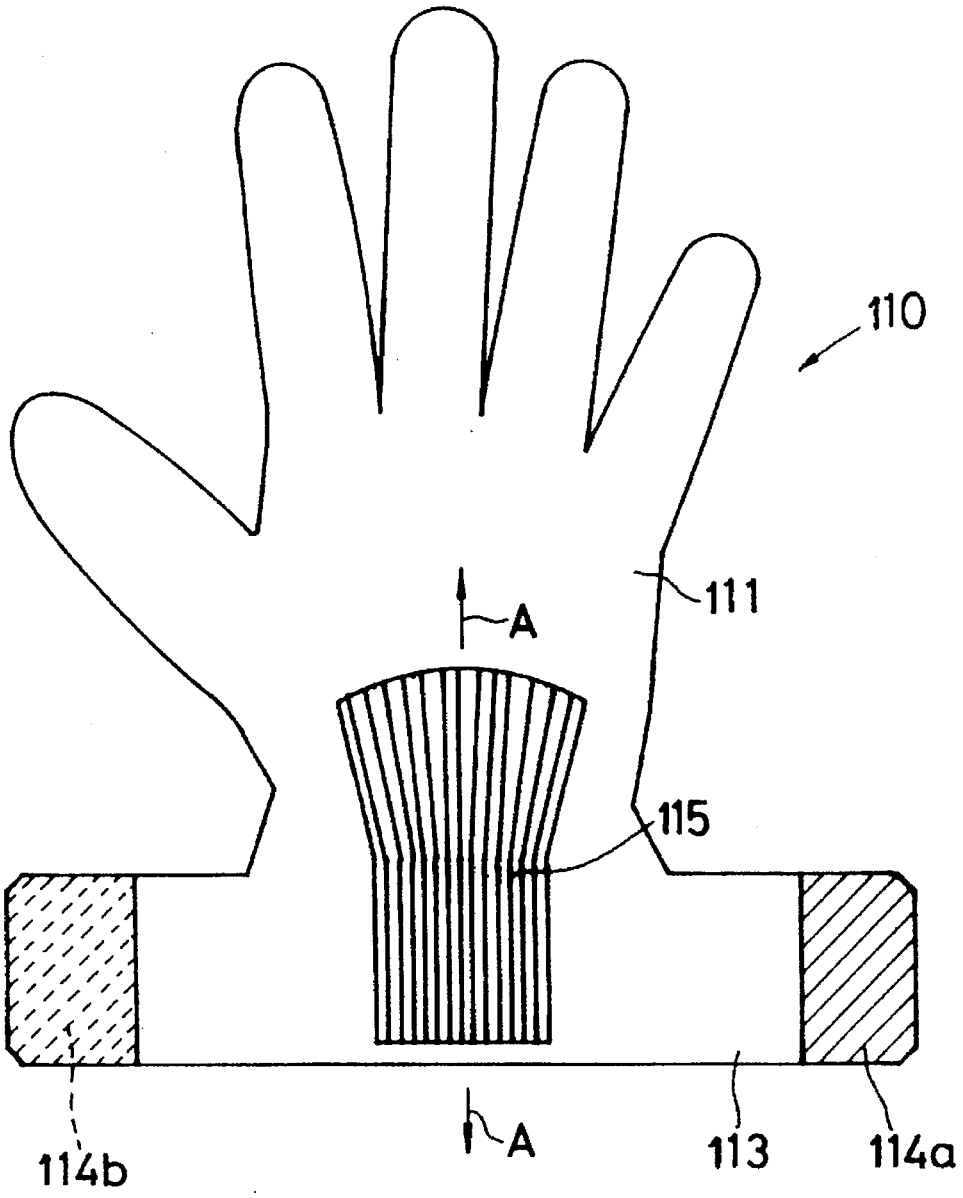
FIG. 2 is a front view of the wrist restraining glove of FIG. 1.

A wrist restraining glove 110 according to the present invention is disclosed in FIG. 1 and FIG. 2. The wrist restraining glove 110 comprises a hand receiving portion 111 for wearing on a hand H covering the five fingers, the palm and the back, a wristlet comprising a band member 113 integrally connected to a wrist end of the hand receiving portion 111, and a tension member (tension means) 115 mounted on a palmar surface of the hand receiving portion 111 and the band member 113. The hand receiving portion 111 is made of cloth, leather etc. The male and female fasteners 114*a*, 114*b* so-called "hook and loop type fastener" are provided at the both ends of the band member 113. After the hand H (the fingers and the palm portion) is inserted into the hand receiving portion 111, the band portion 113 is firmly wrapped around a wrist of the hand H engaging the male fastener 114*a* with the female fastener 114*b*.

The tension member 115 is provided on the palmar surface of the glove 110 extending from the wrist-end toward the knuckle-end. It is made of resilient material such as rubber, resin etc. which can produce a tensile restoring force when stretched. When it is pulled in a direction "A" shown in FIG. 2, a tensile force in a direction opposite to "A" is created in the tension member 115. Therefore, when the hand is pivotally bent outward about the wrist as shown by an arrow "Y" in FIG. 1, the tension member 115 is pulled in the direction of "A" and a force in an opposite direction to "A" (tensile force) is produced in the tension member 115. As a result, when the hand is pivotally bent outward (in a direction of "Y"), the force in an opposite direction to "A" is applied to the hand so as to pull back the hand inward. The further the hand is bent outward, the stronger is the opposite force to "A".

When the hand is stretched straight, the force in an opposite direction to "A" is so set as to be zero or greater than zero.

When the wrist restraining glove 110 is worn on the hand, the outward pivotal movement of the hand about the wrist can be suppressed by the force in an opposite direction to "A". However, the opposite force to "A" has little influence on the lateral (or sideward) pivotal movement (the cocking pivotal movement) of the hand.

Figure 37A:
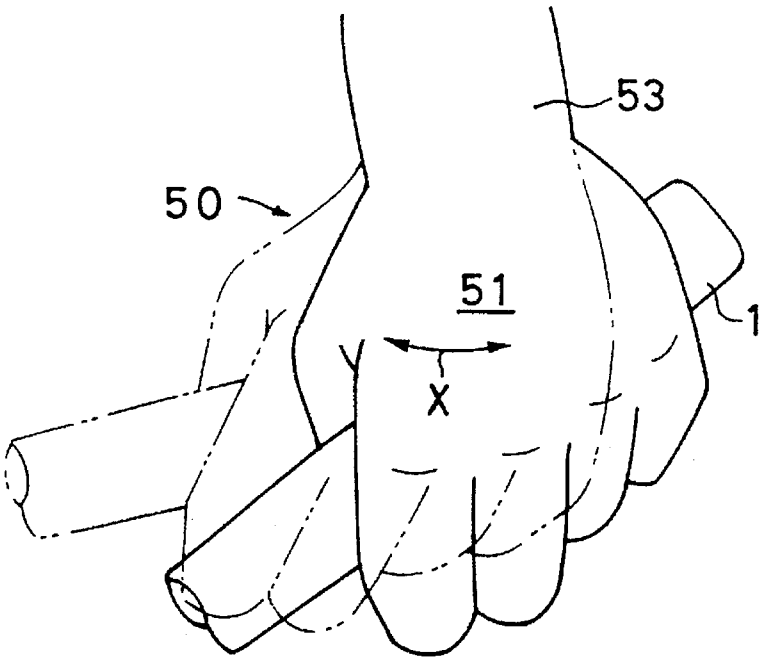
FIGS. 37A and 37B are a rear view and a side view of a hand by which a golf club is grasped.
Figure 37B:
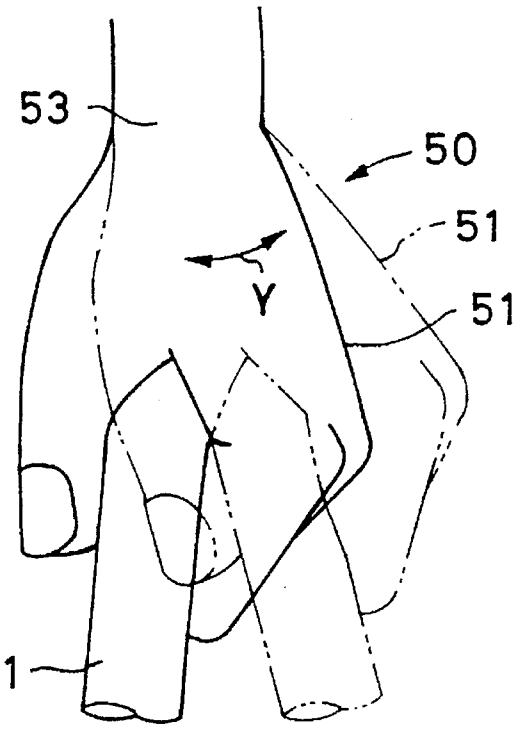
PRIOR ART Fig. 37B

In other words, the pivotal movement of the hand in the direction of "X" in FIG. 37A is permitted but the pivotal movement in the direction of "Y" in FIG. 37B is suppressed by the wrist restraining glove 110 to assist to easily enable an accurate and powerful swing.

When a golf club 1 is swung by the hand H with the wrist restrainer 110, the outward bending pivotal movement of the hand 50 as shown by the arrow "Y" in FIG. 1 can be suppressed during swinging the club 1. Though the tension member 115 suppresses the outward pivotal movement of the hand H, the lateral pivotal movement of the hand H parallel to the back is almost free. As a result, when the golf club 1 is swung by the hand H with the wrist restraining glove 110, only the outward pivotal movement of the hand H is suppressed by the tension member 115 while the lateral pivotal movement (cocking movement) of the hand H is permitted to enable an accurate and powerful swing of the club 1.

At the finishing stage of the swing, the hand H is easily forcibly bent outward by the inertia of the swung club 1, whereby the wrist or the hand could be hurt by being bent excessively. However, if the wrist restraining glove 110 is worn, an excessive bending pivotal movement of the wrist can be prevented by the tension member 115 and the inertia force is absorbed by the tension member 115. Further, the hand H is pulled back inward by the tensile force of the tension member 115.

In the above embodiment, the glove 110 is used for golf, but the wrist restraining glove according to the present invention can be used for other sports, such as tennis, baseball, hockey, etc. In these sports, the glove helps to produce an accurate and powerful swing of a racket, a bat, a stick etc. Further, it helps to prevent an excessive bending pivotal movement of the hand at the finishing stage of the swing.

Figure 3:
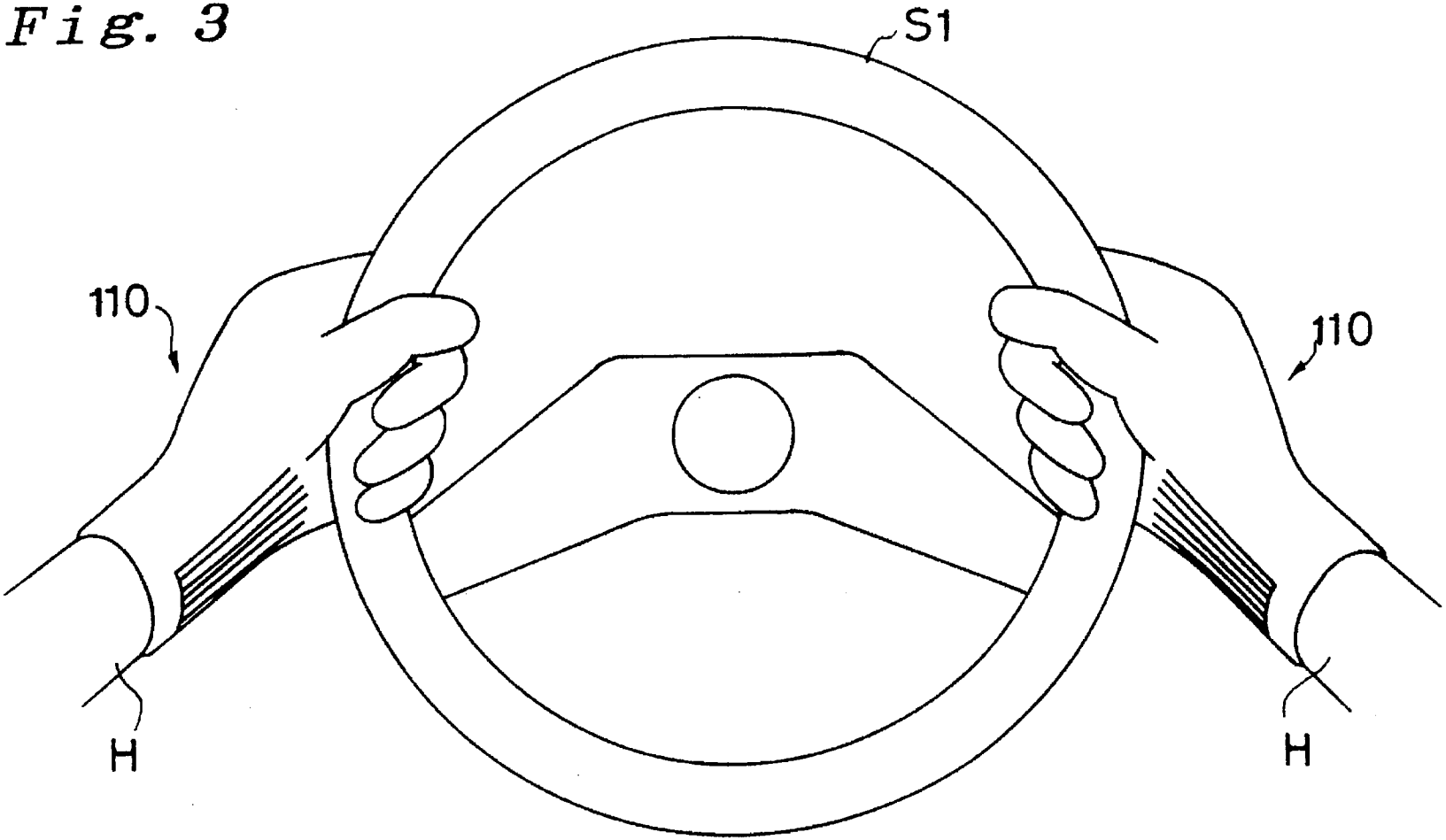
FIG. 3 is a perspective view showing one use of the wrist restraining glove of FIG. 1.
Figure 4:
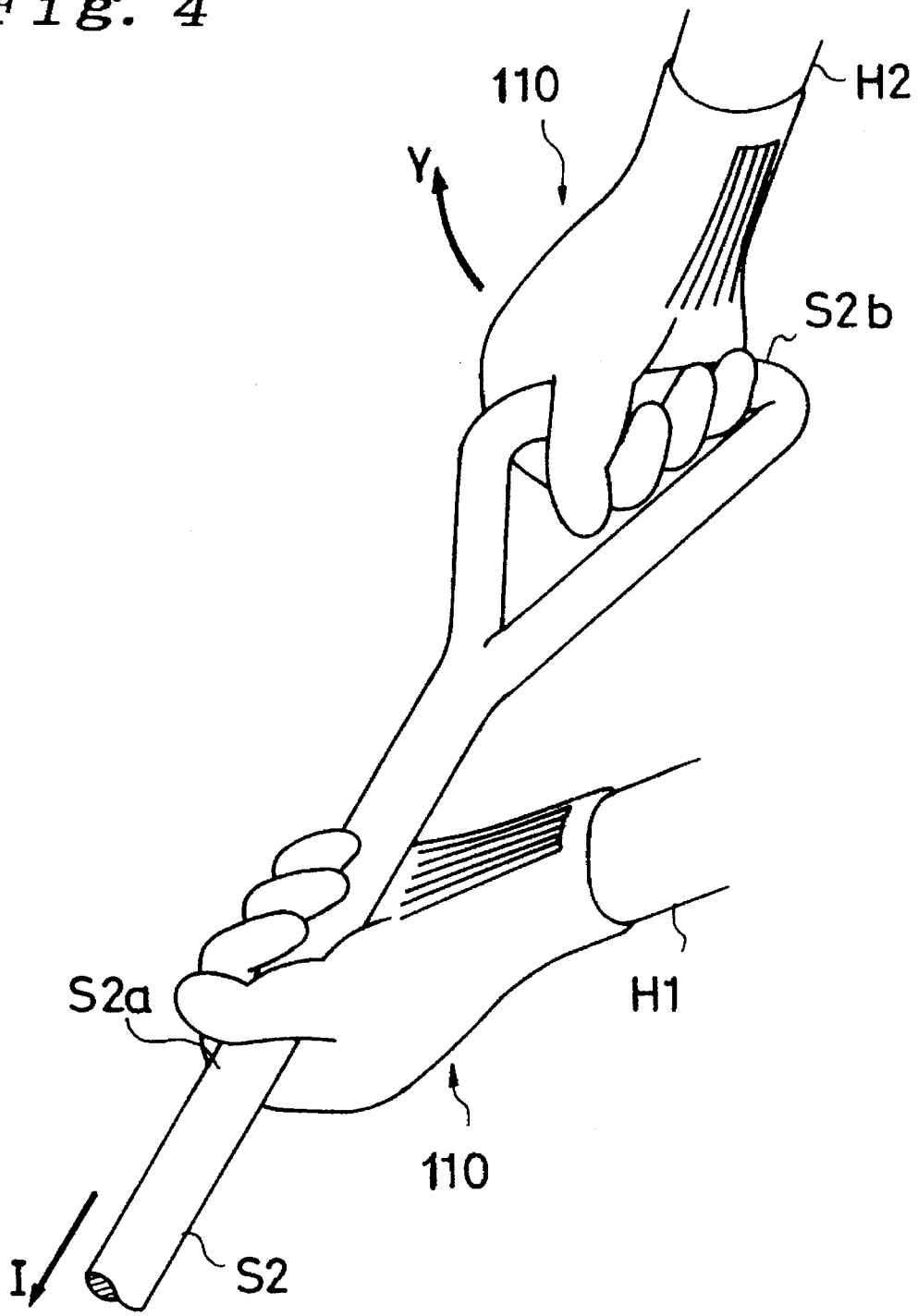
FIG. 4 is a perspective view showing another use of the wrist restraining glove of FIG. 1.

The glove according to the present invention can also used for driving as shown in FIG. 3. When the glove 110 is worn on driver's hands H to grasp a steering wheel S1, an unnecessary outward pivotal movement of the hands H is suppressed to relieve fatigue in the hands during driving. The glove according to the present invention can also used for a physical works, such as for digging the earth by a shovel S2 as shown in FIG. 4 with hands H1 and H2 gripping the shaft and handle S2*a* and S2*b*, respectively. The glove can also used for skiing.

Other embodiments of the glove according to the present invention are described below.

Figure 5:
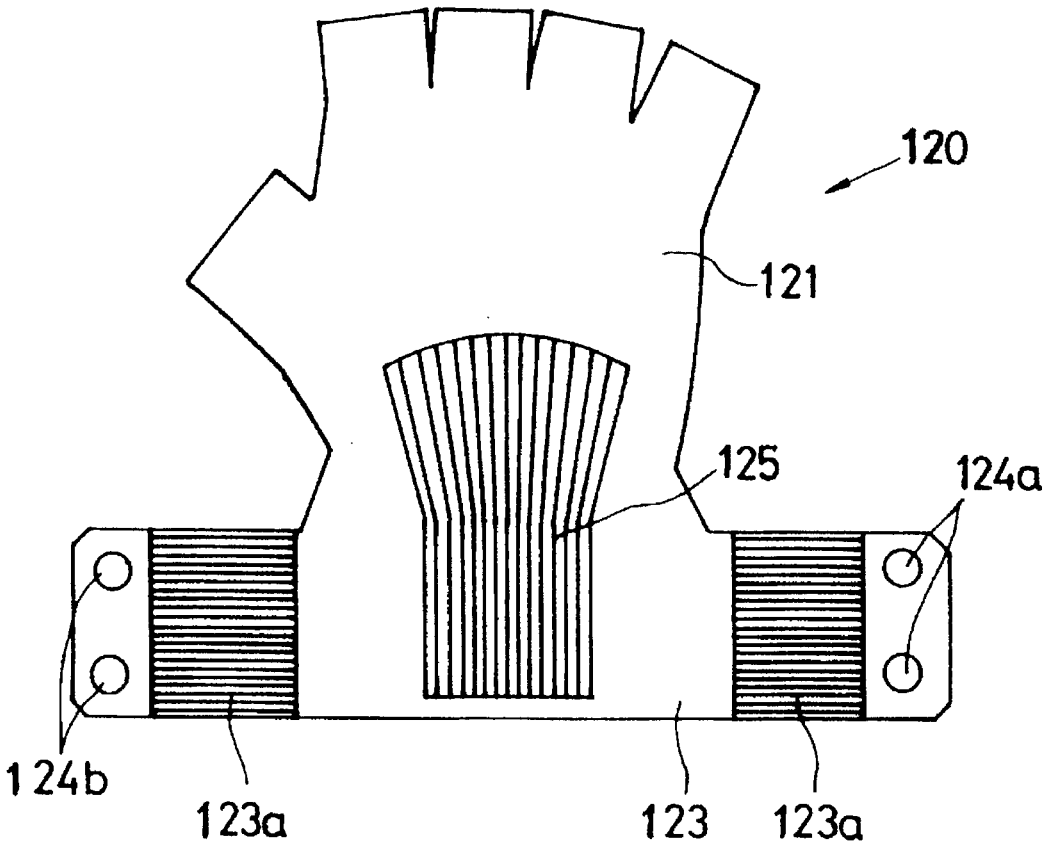
FIG. 5 is a front view of a wrist restraining glove according to the present invention.

A wrist restraining glove 120 shown in FIG. 5 comprises a fingerless hand receiving portion 121, and a band member 123. Intermediate portions 123*a* of the band member 123 is made of rubber to make the wrist band comprising a band member 123 extensible. Male and female buttons 124*a*, 124*b* is provided on the both ends of the band member 123.

A tension member 125 is provided on the palmar surface of the hand receiving portion 121 and the band member 123. It is mounted on the palmar surface extending from the wrist-end toward the knuckle-end.

After a hand is inserted into the hand receiving portion 121, the band member 123 is wrapped around a wrist of the hand engaging the male and female buttons 124*a*, 124*b* with each other. Since the rubber portions 123*a* provide elasticity, the band member 123 is firmly wrapped around the wrist. The tension member 125 provides a resisting force to an outward pivotal movement of the hand about the wrist. Therefore, the outward pivotal movement of the hand during a swing of a golf club can be effectively suppressed.

In the above embodiments, the tension member 115, 125 can be provided so as to produce a tensile force against the outward pivotal movement of the hand only when the hand is bent outward. However, it is preferably provided so as to produce a tensile force to some extent even when the hand is being stretched straight.

Figure 6:
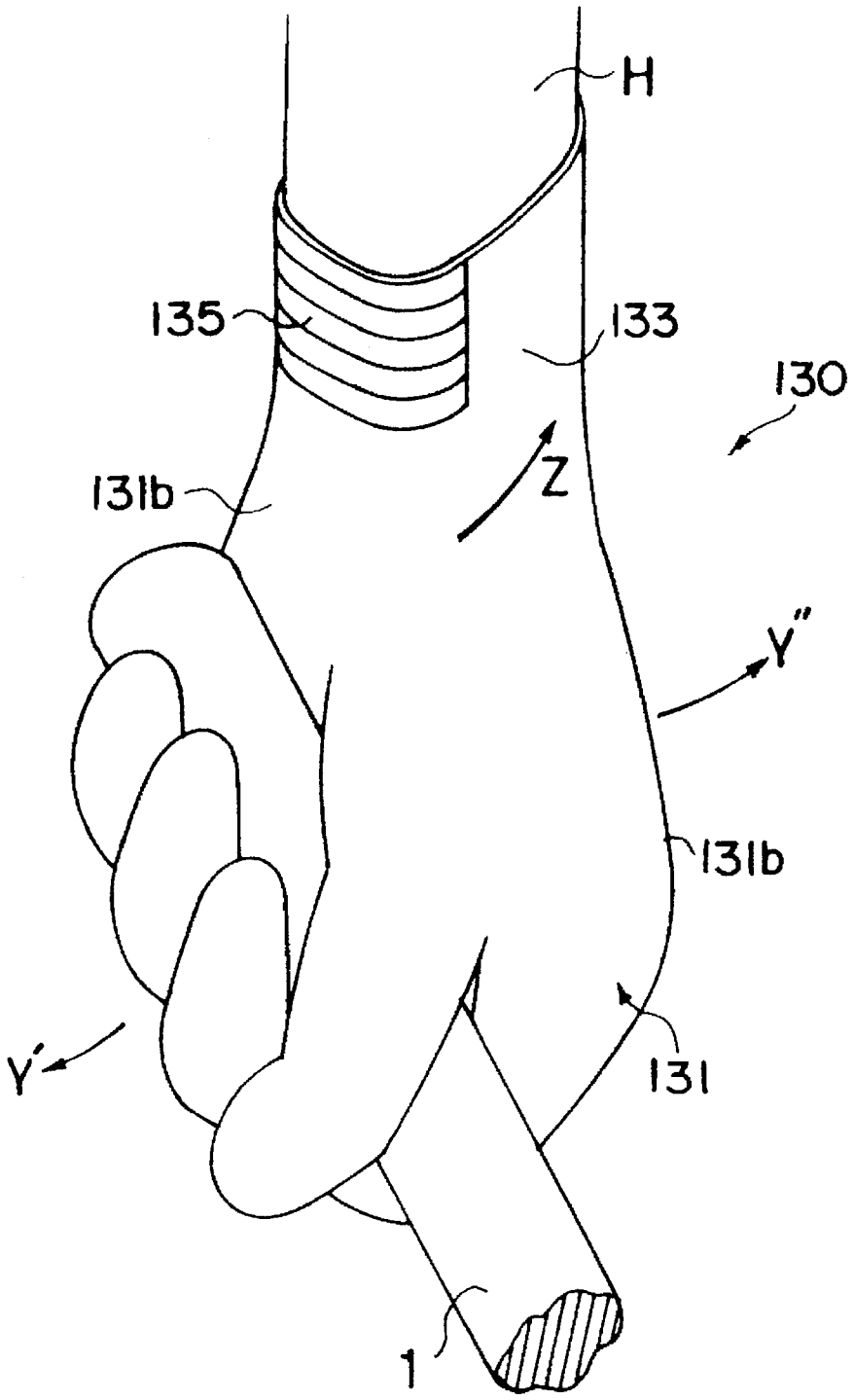
FIG. 6 is a perspective view of a wrist restraining glove according to the present invention which is worn on a hand.
Figure 7:
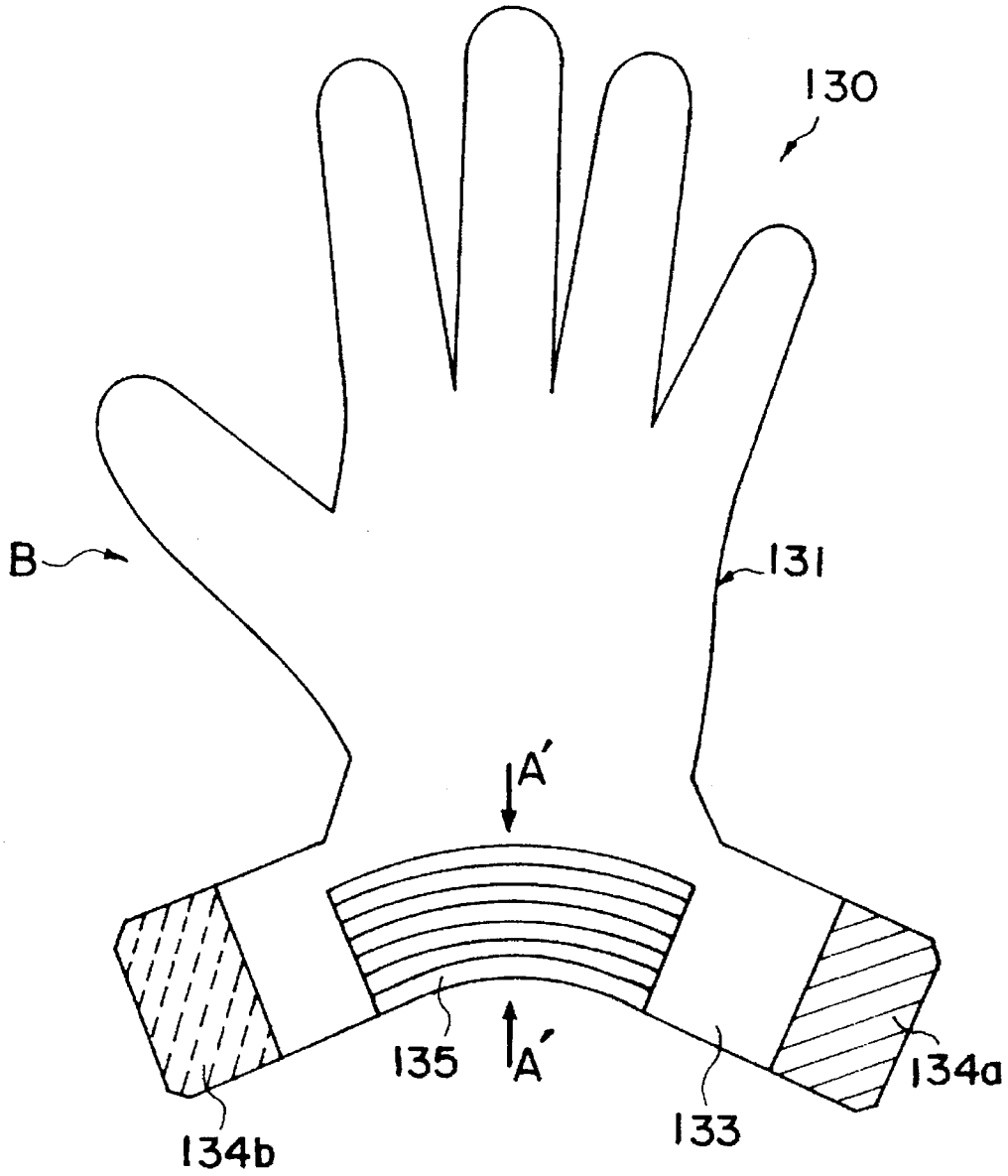
FIG. 7 is a front view of the wrist restraining glove of FIG. 6.
Figure 8:
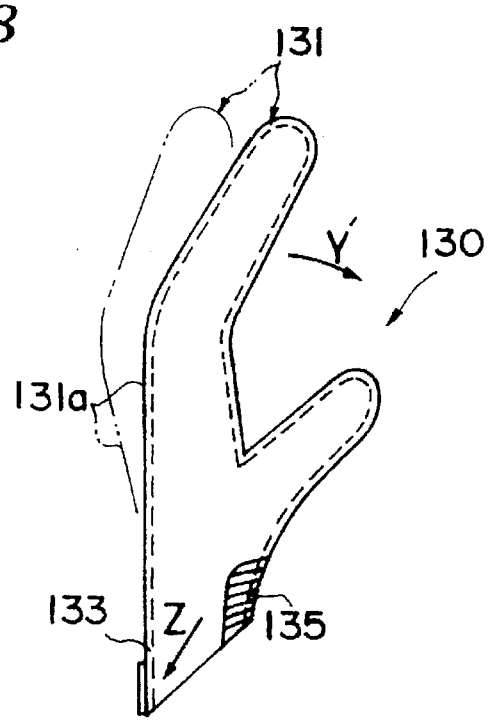
FIG. 8 is a side view of the wrist restraining glove of FIG. 6.

Another wrist restraining glove 130 according to the present invention is shown in FIGS. 6 to 8. The glove 130 comprises a hand receiving portion 131 made of cloth, leather, etc., a band member 133 of a wristlet integrally connected to a wrist end of the hand receiving portion 131, and a tension member 135 mounted on a palmar surface of the band member 133. The tension member 135 is made of resilient material such as rubber, resin etc. It extends from the wrist-end toward the knuckle-end. A male and a female fasteners 134*a*, 134*b* are provided on the both ends of the band member 133.

As shown in FIG. 7, the band member 133 is formed so as to be bent toward the palmar side of the hand. When the glove 130 is worn on the hand and the band member 133 is firmly wrapped around a wrist, the palmar side portion of the glove is pulled toward the wrist as shown by an arrow "Z" in FIG. 8. Accordingly, the hand is pulled so as to be pivotally moved inward about the wrist in the direction shown by an arrow Y'.

Since the tension member 135 has an elasticity, when the hand is outwardly bent about the wrist, a tensile force tending to pull the hand inward is produced in the tension member 135.

Figure 9:
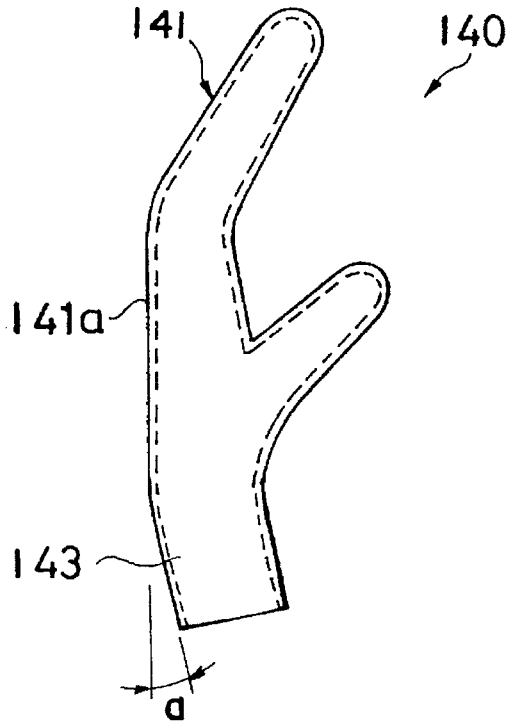
FIG. 9 is a side view of a modified wrist restraining glove.

Another glove according to the present invention can be formed as shown in FIG. 9. The glove 140 comprises a hand receiving portion 141 and a band member or wristlet 143. The back surface of the hand receiving portion 141 inclines to the back surface of the band member 143 by an angle "a". Therefore, the outward pivotal movement of the hand can be effectively suppressed even if no separate tension member is provided. The tension member is constituted by palmar portions of the hand receiving portion of the glove itself.

Figure 10:
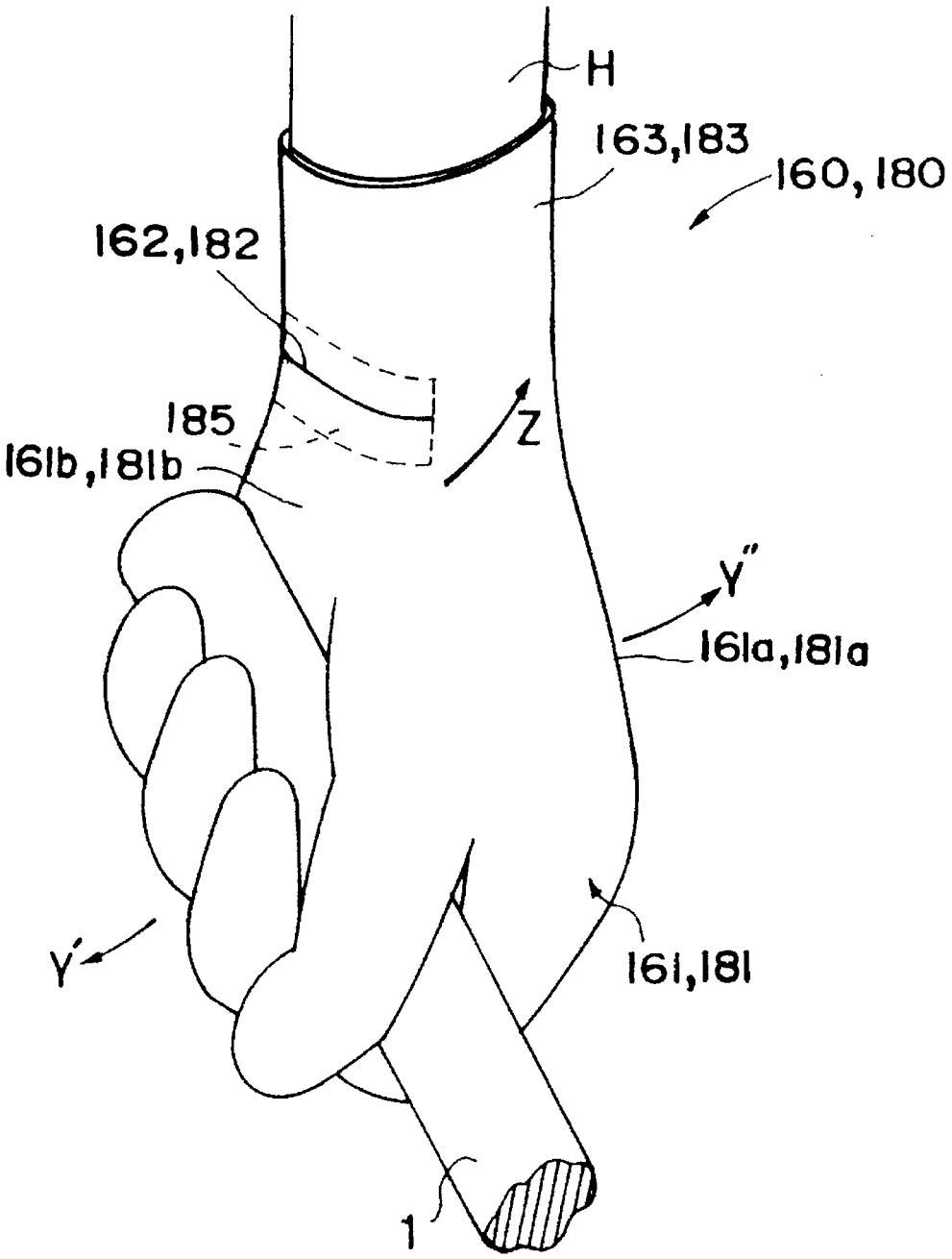
FIG. 10 is a perspective view of a wrist restraining glove according to the present invention which is worn on a hand.

A glove 160 having a cut-out 162 on a palmar surface of the glove is shown in FIG. 10. The cut-out 162 is formed laterally on the palmar surface of the bottom portion of a hand receiving portion 161 (or a portion between the hand receiving portion 161 and a band member 163).

Figure 11A:
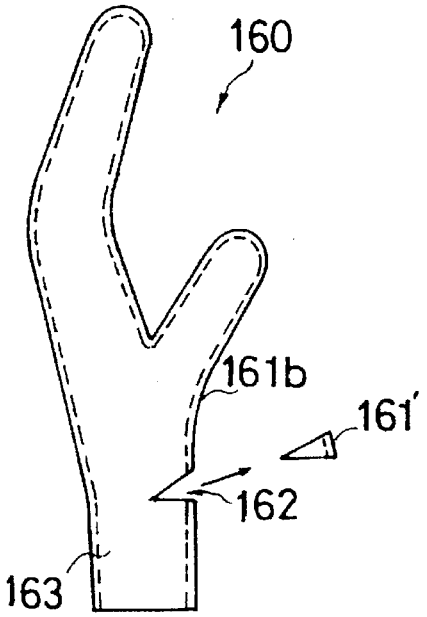
FIGS. 11A and 11B are side views of the wrist restraining glove of FIG. 10.
Figure 11B:
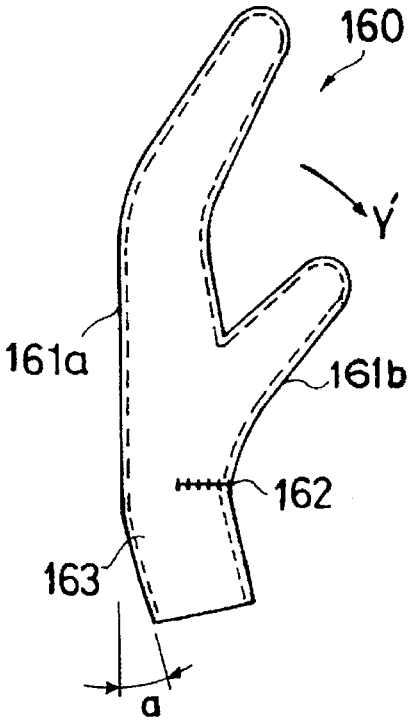

The cut-out 162 is formed as shown in FIG. 11A by removing a part 161' of the hand receiving portion 161*b*. Then the edges of the cut-out are sewed together as shown in FIG. 11B. Accordingly, the back surface of the hand receiving portion 161 inclines to the back surface of the band member 163 by an angle "a".

Figure 12:
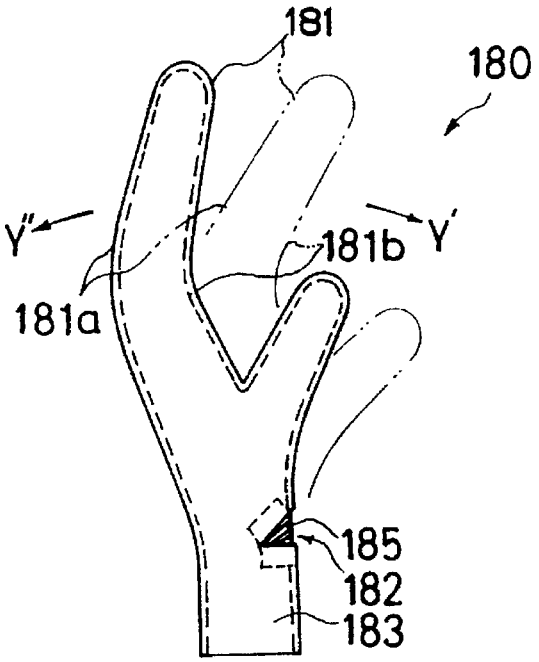
FIG. 12 is a side view of a modified wrist restraining glove.

Further, a glove 180 having a tension member 185 in a cut-out 182 can be formed as shown in FIG. 12. The tension member 185 is made of an resilient material such as rubber. Therefore, the outward pivotal movement of the hand about the wrist can be suppressed though a certain amount of outward pivotal movement (shown by an arrow Y") is permitted.

Figure 13:
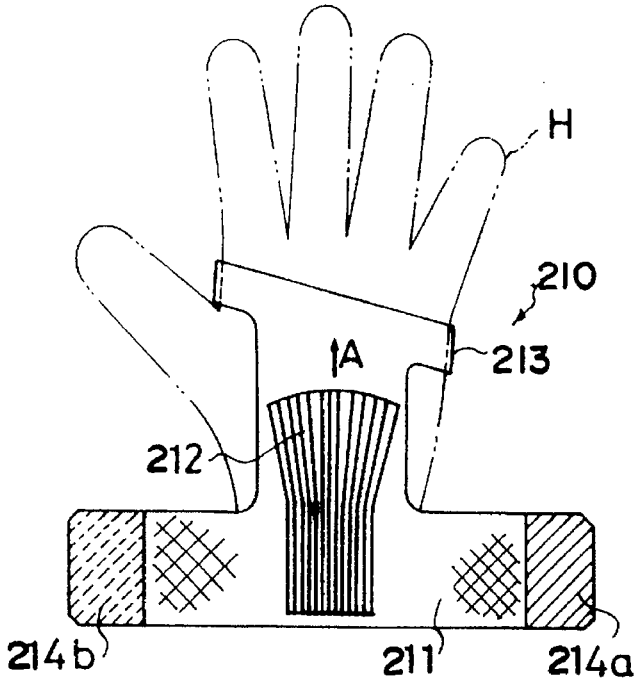
FIG. 13 is a front view of a wrist restrainer according to the present invention.
Figure 14:
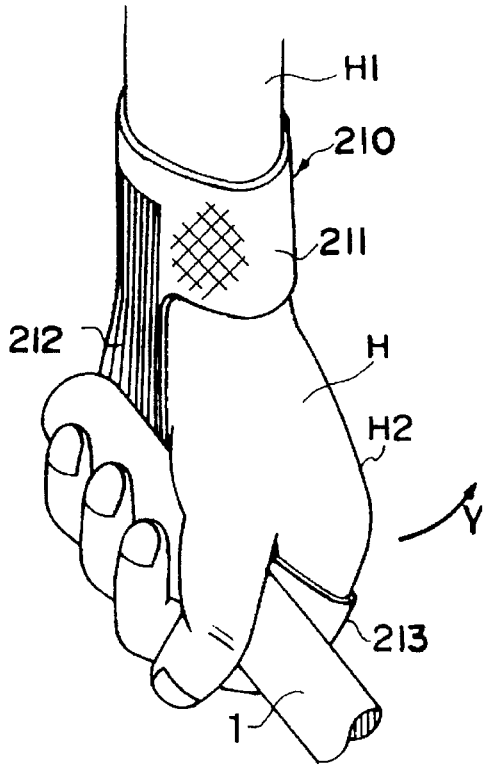
FIG. 14 is a perspective view of the wrist restrainer of FIG. 13 which is worn on a hand.

A different wrist restrainer 210 according to the present invention is shown in FIGS. 13 and 14.

The wrist restrainer 210 comprises a wristlet with a band member 211 having a male and a female fasteners 214*a*, 214*b* so called as "hook and loop type fastener" on the both ends, a palmar member 213 having a ring portion at the tip end, and a tension member 212 integrally mounted on the palmar surfaces of the band member 211 and the palmar member 213.

The band member 211 is made of slightly adhesive material to the skin such as reticulated rubber, resin or plastic, vinyl, leather, carbon fiber, glass fiber or other textiles.

The palmar member 213 is made of cloth or synthetic fiber. The tension member 212 is made of resilient material such as rubber, vinyl, resin (or plastic) or other flexible textiles.

The wrist restrainer 210 is worn on a hand H as shown in FIG. 14. The four fingers are inserted into the ring portion of the palmar member 213, and the band member 211 is firmly wrapped around a wrist H1 engaging the fasteners 214*a*. 214*b* with each other.

When the tension member 212 made of resilient material is pulled as shown by an arrow "A" in FIG. 13, it produces a tensile force against the pulling force "A". Therefore, when the hand is bent outward (in the direction shown by the arrow "Y") about the wrist, the tension member 212 is pulled in the direction of arrow "A" to produce the tensile force therein. The tensile force acts to bend the hand back inward.

As described above, the outward pivotal movement of the hand about the wrist can be suppressed by the tensile force produced in the tension member 212. However, the lateral pivotal movement of the hand parallel to the back of the hand (the pivotal movement called as "a cocking pivotal movement" in a golf swing) is not suppressed.

Figure 15:
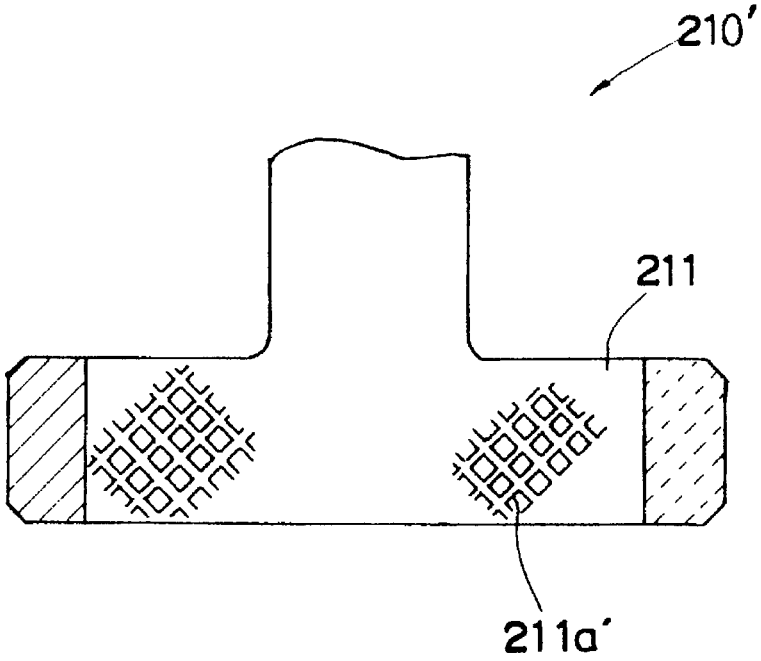
FIGS. 15, 16 are respectively partial rear views of modified wrist restrainers.
Figure 16:
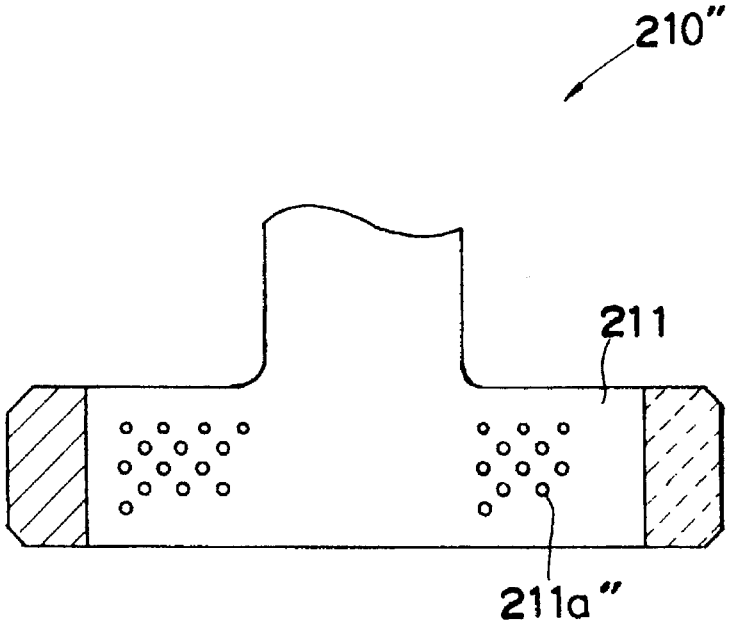

The band member 211 is preferably made of reticulated rubber or textile 211*a'* for improved ventilation of the skin (so as not to become hot and stuffy) as shown in FIG. 15. It can also be made of cloth or rubber with a numerous air-ventilation holes 211*a*" as shown in FIG. 16.

Figure 17:
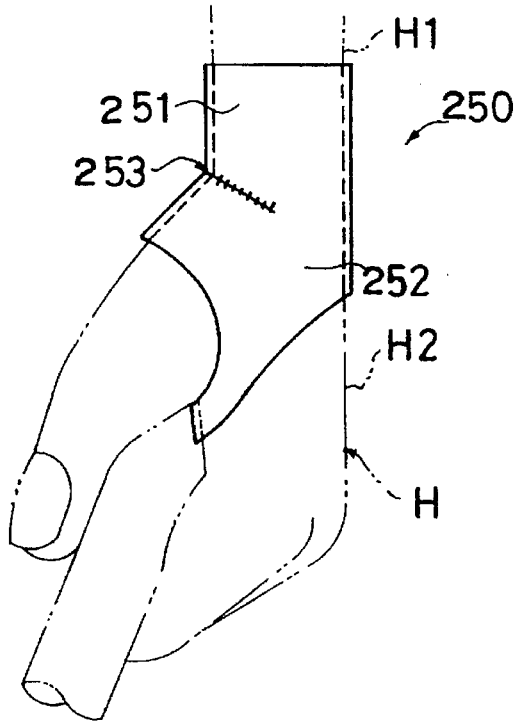
FIG. 17 and FIG. 18 are respectively side views of wrist restrainers according to the present invention.

A different wrist restrainer 250 according to the present invention is shown in FIG. 17. The wrist restrainer 250 comprises a band member 251 and a glove member 252. The glove member 252 is formed so as to cover at least the palm portion of the hand. A hole for inserting a thumb is formed in the glove member 252.

A cut-out 253 is formed laterally on a palmar surface of the glove member 252 (or on a palmar surface between the glove member 252 and the wristlet or band member 251). The cut-out is sewed together so as to bend the hand receiving portion 252 inward. Accordingly, when the wrist restrainer 250 is put on the hand, the outward pivotal movement of the hand can be suppressed. The wrist restrainer 250 is preferably to be made of resilient textile which is extensible longitudinally, whereby the pivotal movement of the hand can be permitted.

Figure 18:
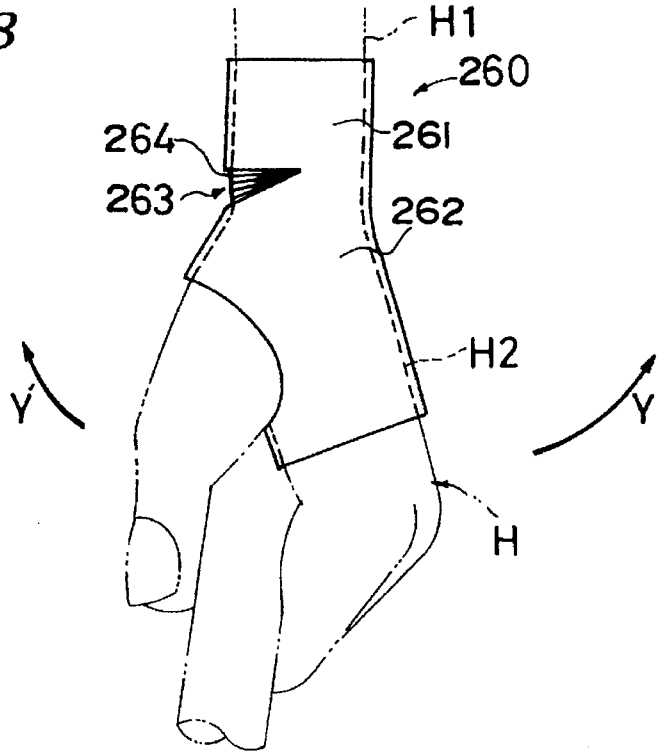

A variation of the above wrist restrainer is shown in FIG. 18. The wrist restrainer 260 shown in FIG. 18 also has a cut-out 264. But, instead of sewing the cut-out in a glove member 262, closed a tension member 264 is provided in the cut-out 264.

When the hand H is bent outward as shown by an arrow Y in FIG. 18, a resisting tensile force to pull back the hand inward as shown by an arrow Y' is produced by the tension member 264. Therefore, the outward pivotal movement of the hand is permitted to some extent but the hand can be pulled back inward so as not to be bent outward excessively.

Figure 19:
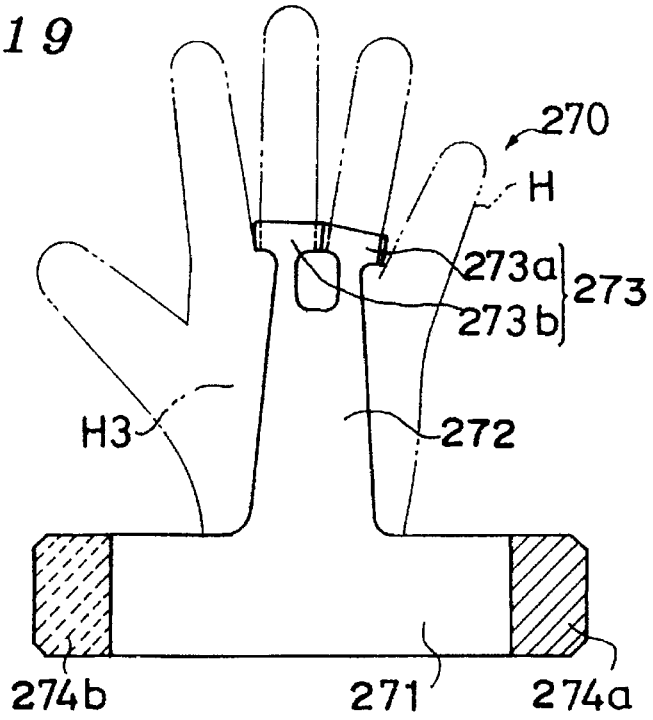
FIG. 19 and FIG. 20 are, respectively, front views of wrist restrainers according to the present invention.

A different wrist restrainer 270 according to the present invention is shown in FIG. 19. The wrist restrainer 270 comprises a band member 271, a palmar member 272 and finger ring members 273 (273*a*, 273*b*). The two fingers are inserted into the finger ring members 273*a*, 273*b* respectively as shown in FIG. 19. The band member 271 and the palmar member 272 are preferably made of resilient material such as extensible textile.

Figure 20:
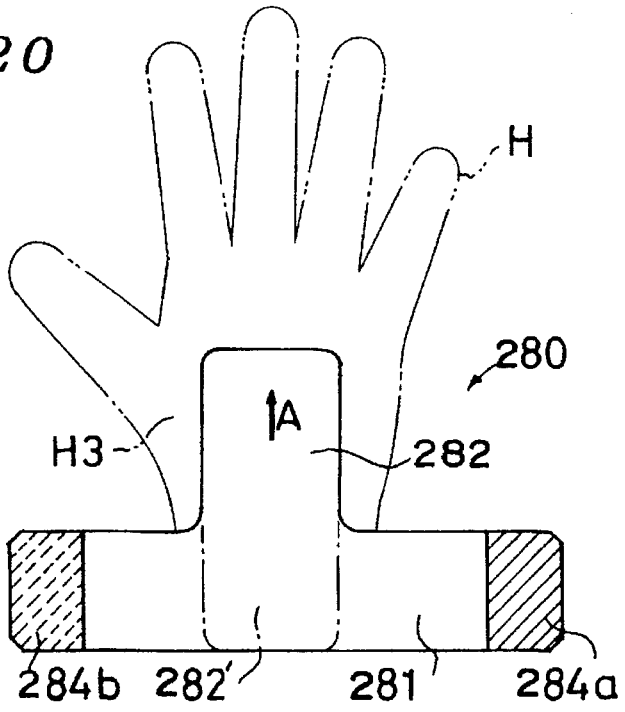

A simple wrist restrainer 280 as shown in FIG. 20 can be used. The wrist restrainer 280 comprises a band member 281 and a simple palmar member 282. When a golf club is grasped by a hand H, The palmar member 282 is sandwiched between the hand H and the club. Therefore, when the hand is moved out-ward, the palmar member 282 is pulled to resist the outward pivotal movement of the hand.

Figure 21A:
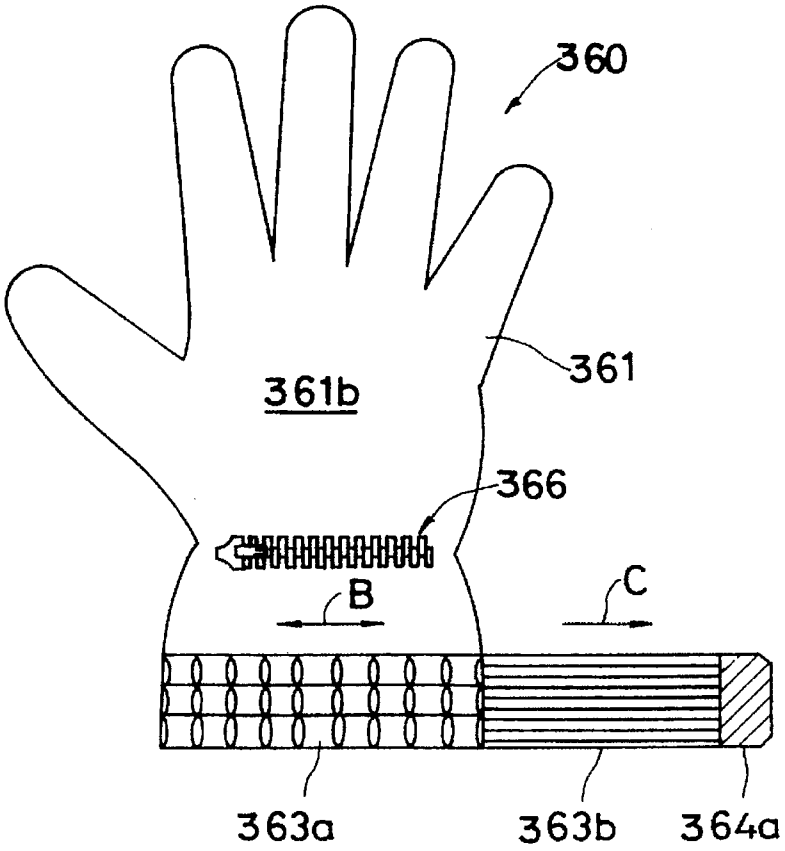
FIGS. 21A and 21B are, respectively, front and rear views of a wrist restraining glove according to the present invention.
Figure 21B:
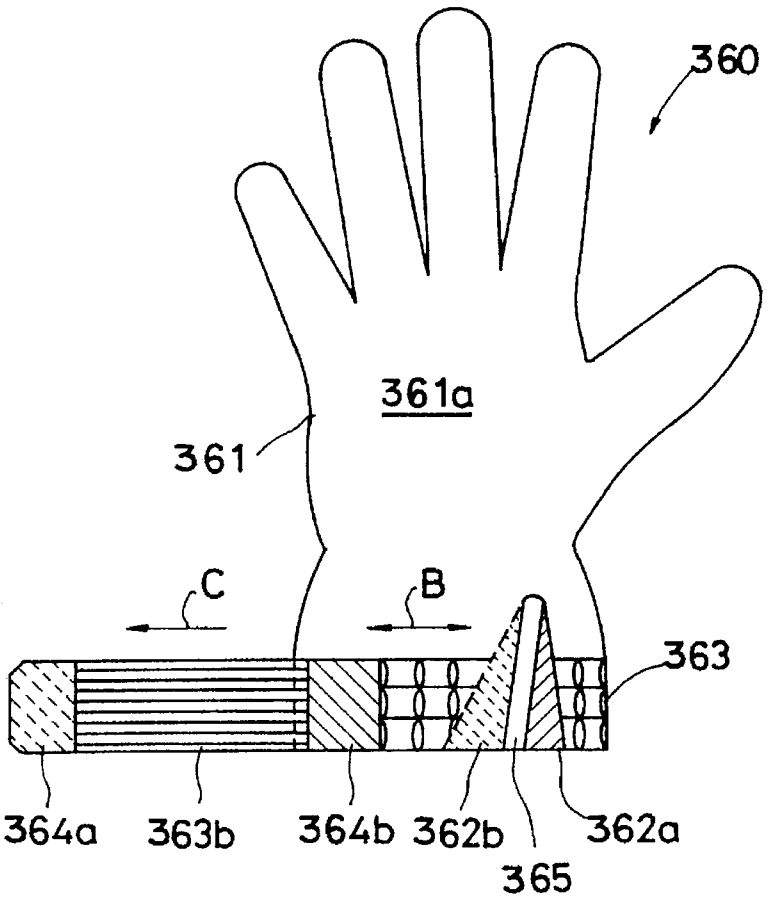

Another wrist restraining glove 360 according to the present invention is shown in FIGS. 21A and 21B. FIG. 21A shows the palmar side of the glove 380 and FIG. 21B shows the back side of the glove 360.

The wrist restraining glove 360 comprises a hand receiving portion 361 made of cloth, leather etc., and a wristlet 363 integrally formed with the hand receiving portion 361. The wristlet 383 includes a wrist wrapping member 383*a* and a band member 363*b*.

As shown in FIGS. 32A and 32B, a lateral cut-out 367 is formed on a palmar surface 361*b* between the hand receiving portion 361 and the wristlet 363, and a zip fastener 366 is provided on the cut-out. The wrist wrapping member 363*a* includes an resilient material so as to be extensible in a direction of "B".

A longitudinal cut-out 365 is formed on a back surface 361*a* of the wristlet 363. On the outer surface and the inner surface of the wrist wrapping member 363*a*, a male and a female fastener 362*a*, 362*b* such as a hook and loop type fastener are provided. After a hand is inserted into the hand receiving portion 361, the fasteners 362*a*, 362*b* are engaged with each other to firmly wrap the wrist by the wrapping member 363*a*.

Further, the band member 363*b* is connected to the wrapping member 363*a*. The band member 363*b* can be wrapped over the wrapping member 363*a*, and is extensible in a direction of "C". A male and a female fasteners 364*a*, 364*b* are provided on a tip end of the band portion 363*b* and on the wrapping portion 363*a* as shown in FIG. 21B. The band member 363*b* is wrapped over the wrapping member 363*a* and the fasteners 364*a*, 364*b* are firmly engaged with each other. As a result, the wristlet 363 is firmly wrapped around the wrist.

Figure 22A:
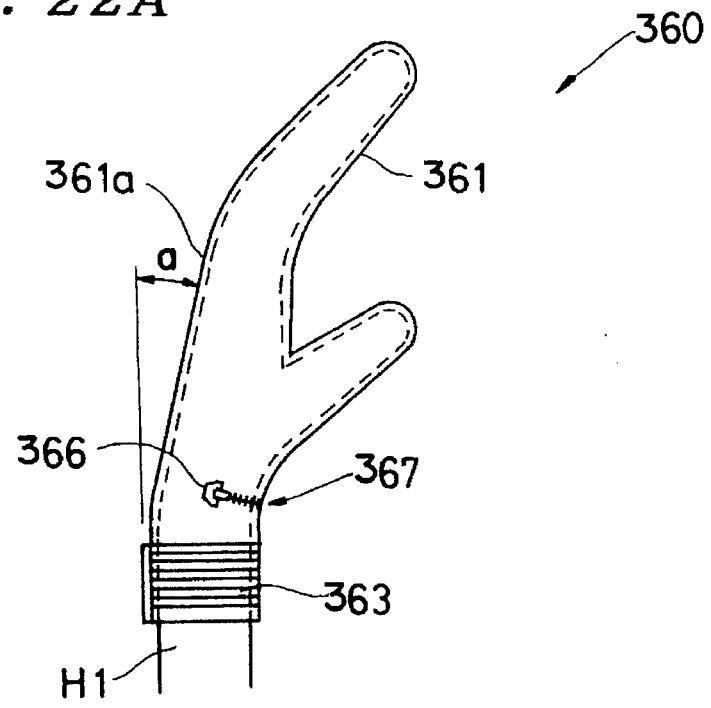
FIGS. 22A and 22B are side views of the wrist restraining glove of FIGS. 21A and 21B showing a zip fastener in a closed and open state, respectively.

Then, the zip fastener 366 is closed as shown in FIG. 22A. When the zip fastener 366 is closed, the back surface 361*a* of the hand receiving portion 361 inclines inward to the back surface of the wristlet 363 by an angle "a". The angle "a" can be adjusted by changing the width of the lateral cut-out 367.

Figure 22B:
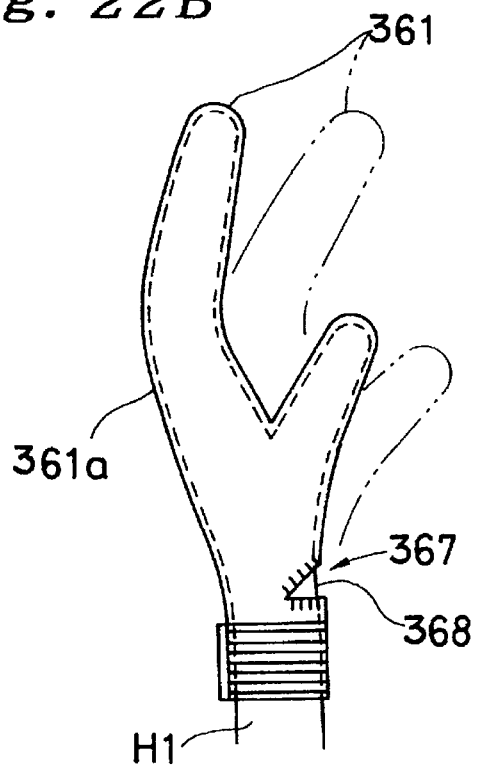

When the zip fastener 388 is opened, the hand receiving portion 381 (and the hand) can be bent outward as shown in FIG. 22B.

Accordingly, when the zip fastener 366 is closed, the outward pivotal movement of the hand about the wrist can be effectively suppressed during a swing of a golf club. The closed zip fastener 366 restricts the outward pivotal movement of the hand but does not restricts the lateral pivotal movement (the cocking pivotal movement) of the hand to permit a smooth swing of the club. The hand receiving portion 361 and the wristlet 363 are preferably made of resilient material such as extensible textile.

Figure 23A:
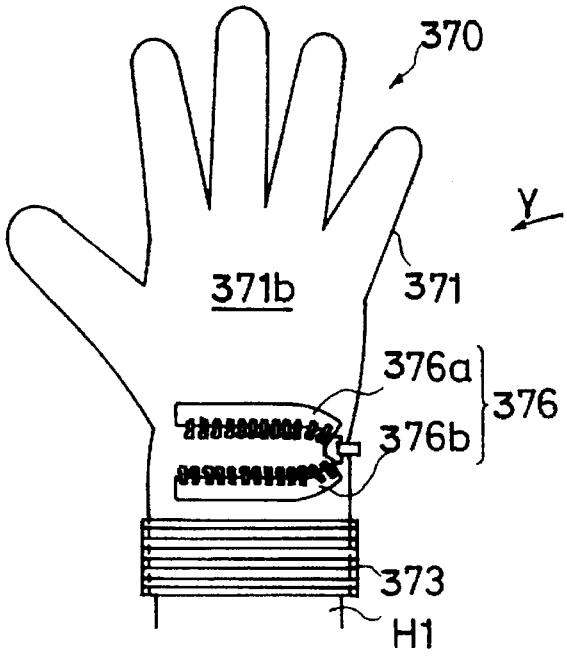
FIGS. 23A and 23B are respectively, front and side views of a wrist restraining glove according to the present invention.
Figure 23B:
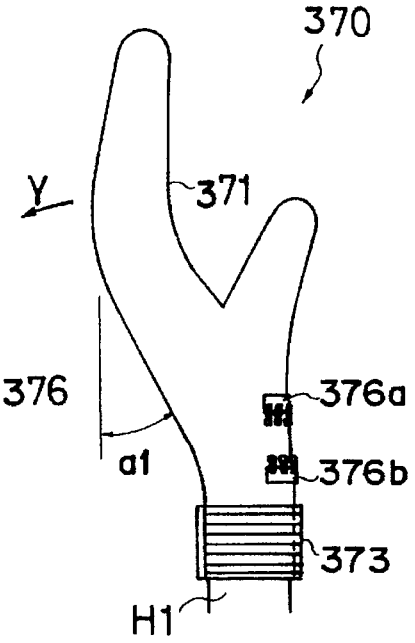
Figure 24A:
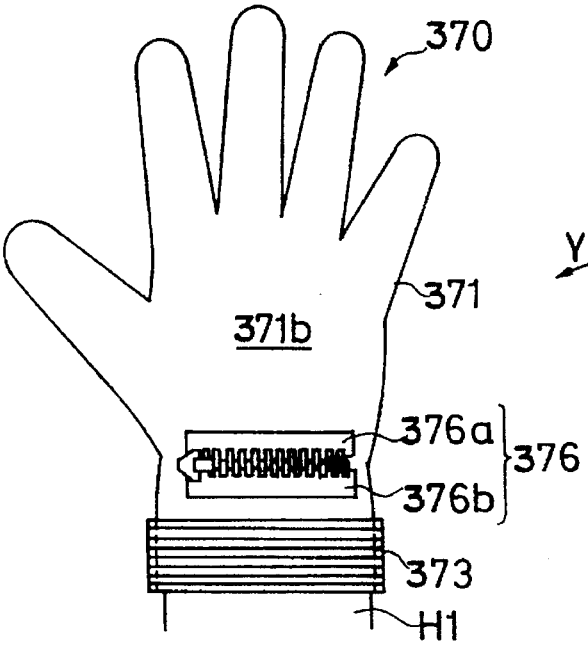
FIGS. 24A and 24B are respectively, front and side views of the wrist restraining glove of FIGS. 23A and 23B showing a zip fastener in a closed and open state, respectively.
Figure 24B:
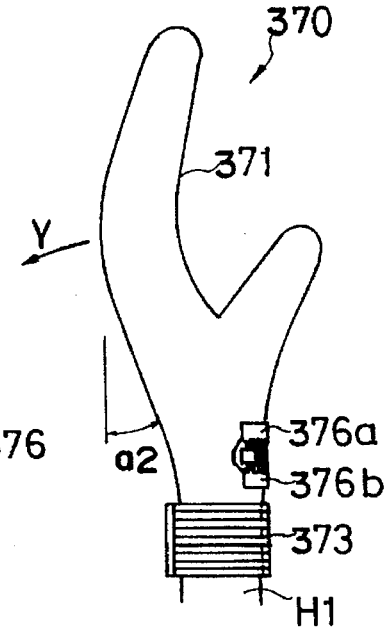

A variation of the wrist restraining glove is shown in FIGS. 23–24. The wrist restraining glove 370 comprises a hand receiving portion 371 and a wristlet 373. The wristlet 373 has the same construction as that of the glove 360 shown in FIGS. 21–22. A zip fastener 376*a*, 376*b* is also provided on a palmar surface 371*b* of the hand receiving portion 371. The only difference between these gloves 360 and 370 is the lateral cut-out 367 of the glove 360. No cut-out is formed on the glove 370.

When the zip fastener 376*a*, 376*b* is opened, the outward pivotal movement of the hand is largely permitted as shown in FIGS. 23A and 23B. Namely, the outward bending angle "a1" of the hand is large. But, when the zip fastener is closed, the outward pivotal movement is restricted as shown in FIGS. 34A and 34B. The outward bending angle "a2" is small.

Figure 25A:
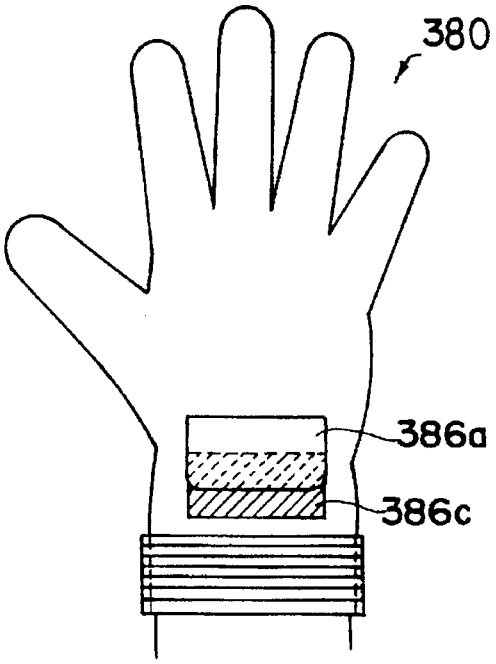
FIGS. 25A and 25B are respectively, front and side views of a wrist restraining glove according to the present invention.
Figure 25B:
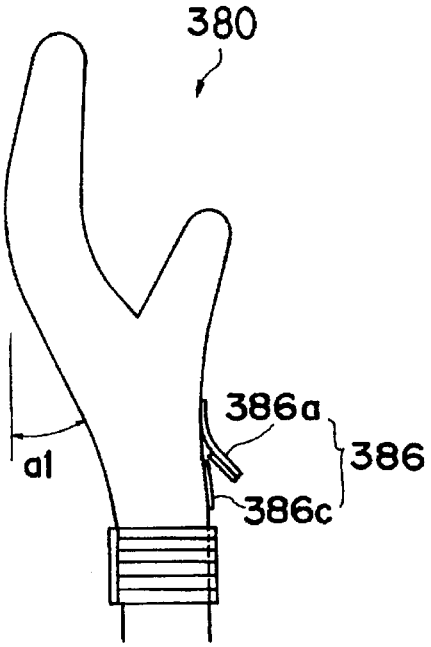
Figure 26A:
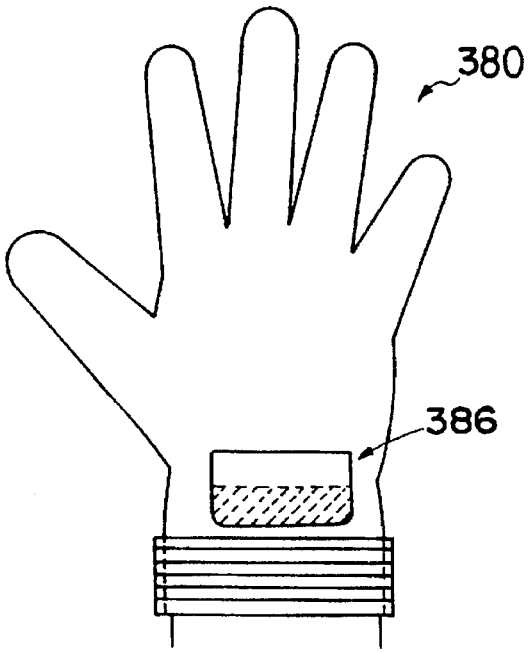
FIGS. 26A and 26B are respectively, front and side views of the wrist restraining glove of FIGS. 25A and 25B showing a zip fastener in a closed and open state, respectively.

Instead of the zip fastener 376*a*, 376*b*, a male and female fasteners 386*a*, 386*c* so-called as a hook and loop type fastener can be used to compose a wrist restraining glove 380 as shown in FIGS. 25–26.

Figure 26B:
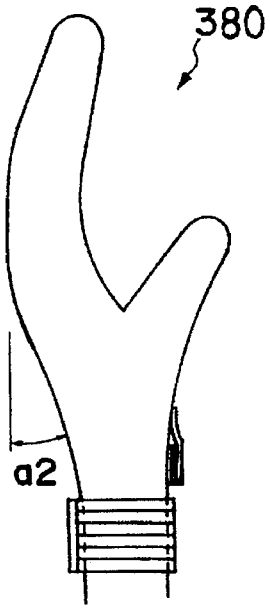

When the fasteners 386*a*, 386*c* are disengaged, a large outward pivotal movement of the hand is permitted as shown in FIG. 25B. Namely, the outward bending angle "a1" of the hand is large. But, when the fasteners are engaged with each other, the outward pivotal movement is restricted as shown in FIG. 26B. Since the engaging position of the fasteners 386*a*, 388*c* can be adjusted, the outward bending angle "a2" is adjustable.

Figure 27:
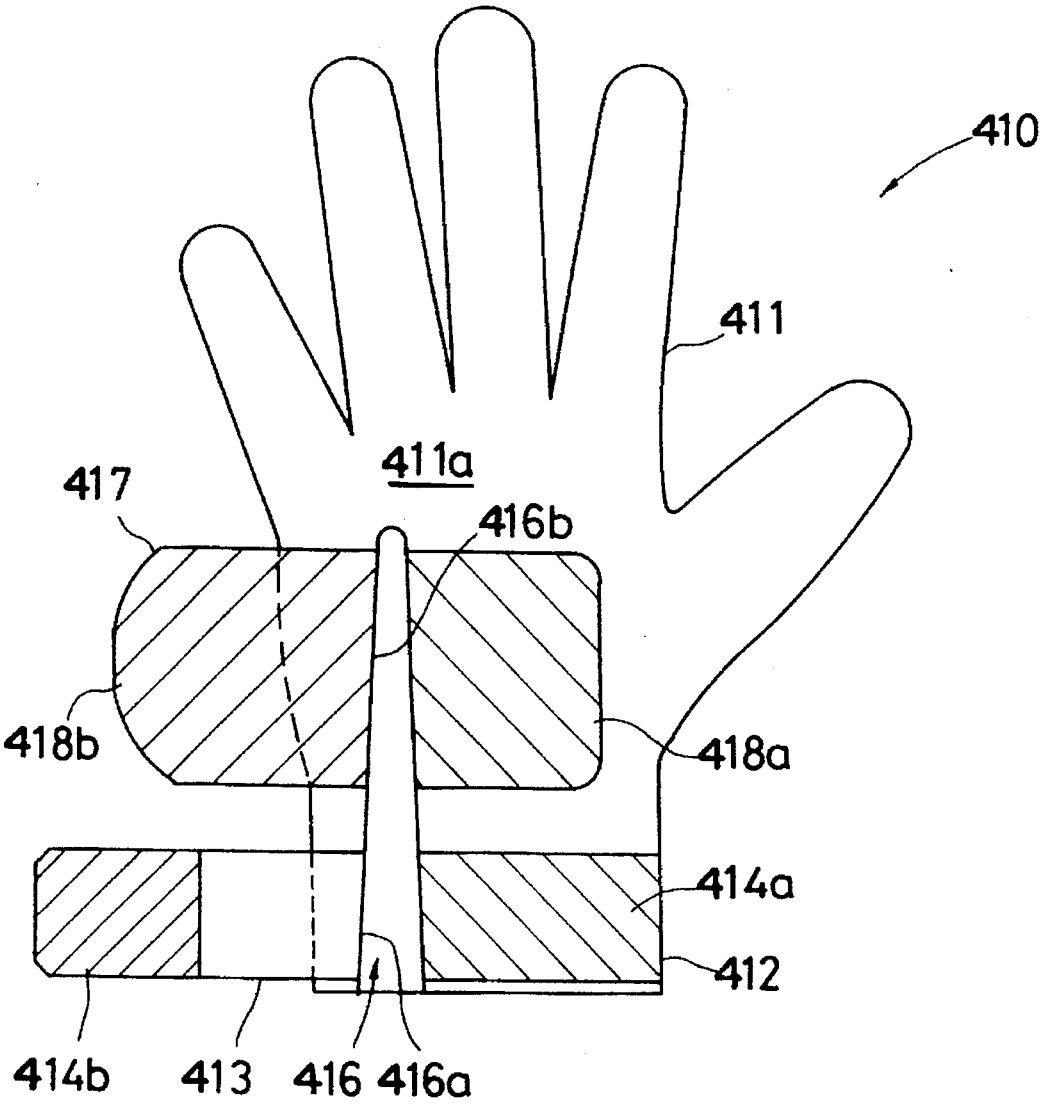
FIG. 27 is a rear view of a wrist restraining glove according to the present invention.
Figure 28:
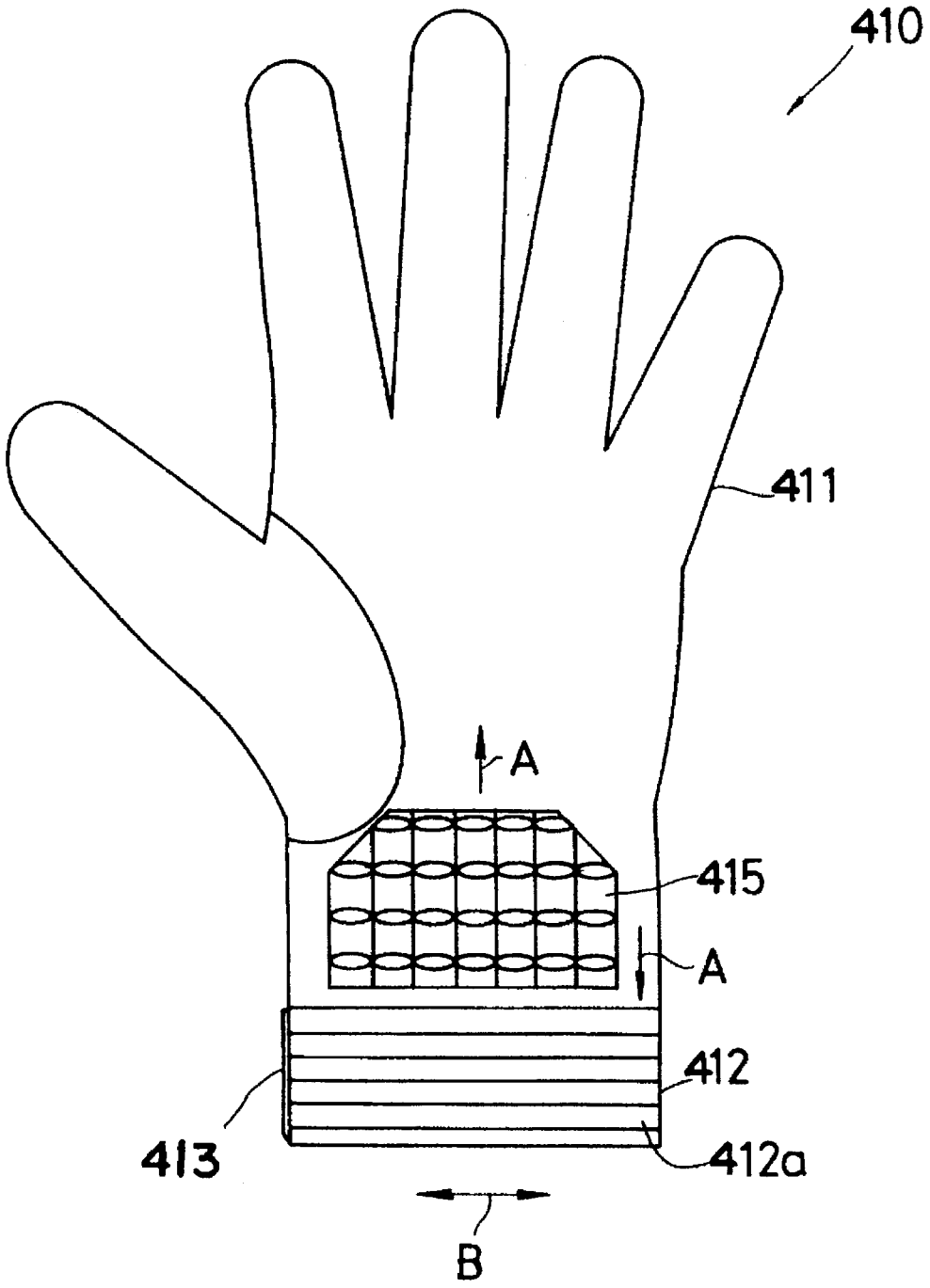
FIG. 28 is a front view of the wrist restraining glove of FIG. 27.

A different wrist restraining glove 410 according to the present invention is shown in FIGS. 27 and 28. FIG. 27 shows a back side of the glove 410 and FIG. 28 shows a palmar side.

The wrist restraining glove 410 comprises a hand receiving portion 411 for receiving five fingers, a wristlet 412 integrally connected to the hand receiving portion 411. A longitudinal cut-out 416 is formed on the back side of the glove 410. The cut-out 416 is formed on the left side (near the fifth finger) so as to give a space for fasteners on the back surface of the glove 410.

A wrist band member 413 is connected to the wristlet 412 at the left edge 416*a* of the cut-out 416. A portion (a palmar portion) of the wristlet 412 includes an extensible member 412*a* made of resilient material such as rubber to produce a tensile force as shown be an arrow "B" in FIG. 38, when being wrapped around the wrist.

Figure 29A:
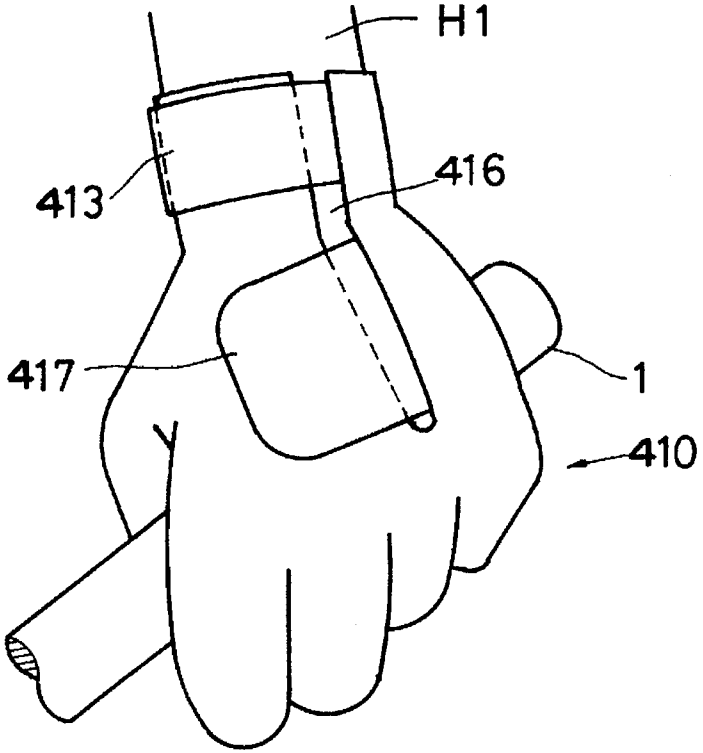
FIGS. 29A and 29B are perspective views of the glove of FIG. 27 worn on the hand.
Figure 29B:
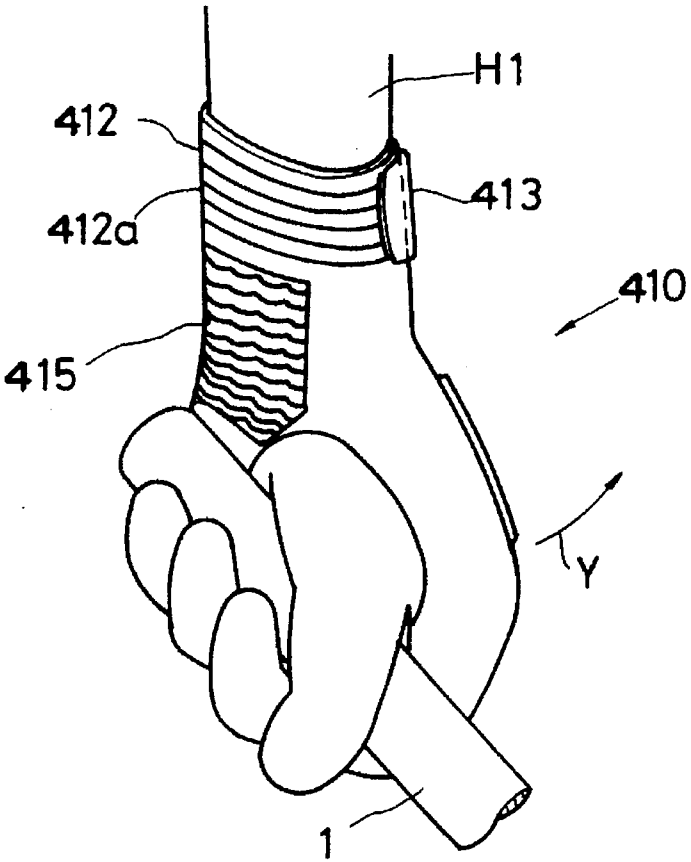

When the glove is worn on a hand, the wrist band member 413 is wrapped over the wristlet 412 around a wrist H1 as shown in FIGS. 29A and 29B. When the wrist band member 413 is wrapped over the wristlet 412, a male and a female fasteners 414*a*, 414*b* are engaged with each other to keep the wrist band member 413 being wrapped firmly.

A back fastening flap member 417 is connected to the hand receiving portion 411 at the left edge 416*b* of the cut-out 416. A male and a female fasteners 418*a*, 418*b* are provided on a inner surface of the back fastening flap member 417 and on the outer back surface 411*a* of the hand receiving portion 411.

A tension member 415 is provided on the bottom palmar surface of the hand receiving portion 411. The tension member 415 is made of an resilient material and is extensible in a direction as shown by arrows "A" in FIG. 28.

Because of elasticity of the tension member 415, when it is pulled in a direction "A" as shown in FIG. 28, it produces a resisting tensile force opposite to the force "A". When the hand is bent outward (in a direction shown by an arrow "Y" in FIG. 29B), the tension member 415 produces the resisting tensile force. Accordingly, when the hand is bent outward, the tension member 415 pulls back the hand inward.

Figure 30:
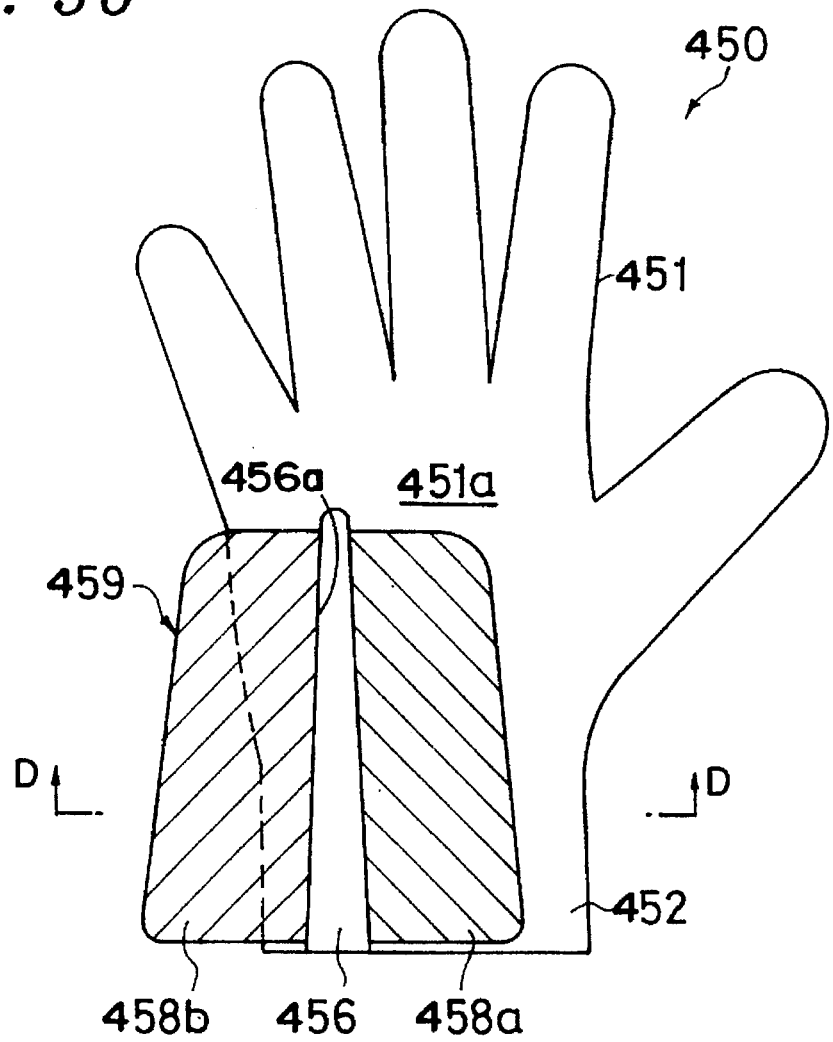
FIG. 30 is a rear view of a wrist restraining glove according to the present invention.
Figure 31:
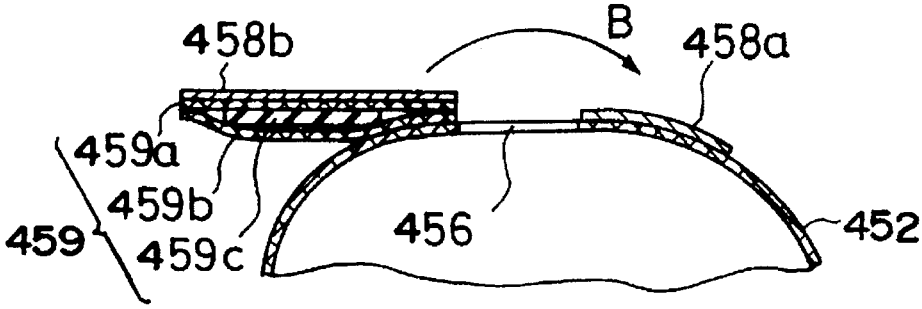
FIG. 31 is a cross-sectional view along a line 31—31 in FIG. 30.

Another wrist restraining glove 450 according to the present invention is shown in FIGS. 30 and 31. The glove 450 comprises a hand receiving portion 451 and a wrist potion 452.

A longitudinal cut-out 456 is formed on a back surface of the glove 450. The cut-out 456 is formed on the left side (near the fifth finger) so as to give a space for a back restraining flap member 459 on the back surface of the glove 450. The back restraining flap member 459 which can cover the back surface of the hand receiving portion 451 and the wristlet 452 is connected to the left edge 456*a* of the cut-out 456.

A male and a female fasteners 458*a* and 458*b* which can be engaged with each other are provided on the inner surface of the back restraining flap member 459 and on the outer back surface of the glove 450. The fasteners 458*a* and 458*b* may comprise so-called hook and loop type fasteners.

The back restraining flap member 459 comprises an inner plane member 459*a* on which the fastener 458*b* is attached, and an outer plane member 459*b*. The peripheries of the inner and outer plane members 459*a*, 459*b* are sewed together to form an envelope-shape inner space or pocket between the plane members 459*a*, 459*b*. A restraining plate 459*c* made of resilient material such as rubber is loosely placed in the inner space which is formed between the plane members 459*a*, 459*b*.

Though not being illustrated in FIGS. 30 and 31, a tension member is provided on the palmar surface of the glove 450 which is similar to that shown in FIGS. 1 and 2.

When the glove 460 is worn on a hand, the back restraining flap member 459 is folded on the back surface of the glove 450 to engage the male and female fasteners 458*a*, 458*b* with each other. Therefore, a wrist is firmly wrapped by the wristlet 452.

The outward pivotal movement of the hand about the wrist is effectively suppressed by not only the tension member on the palmar surface but also the restraining flap member 459. Since the restraining plate 459*c* is loosely placed in the inner space between the plane members 459*a*, 459*b*, the lateral pivotal movement of the hand is not restricted.

Figure 32:
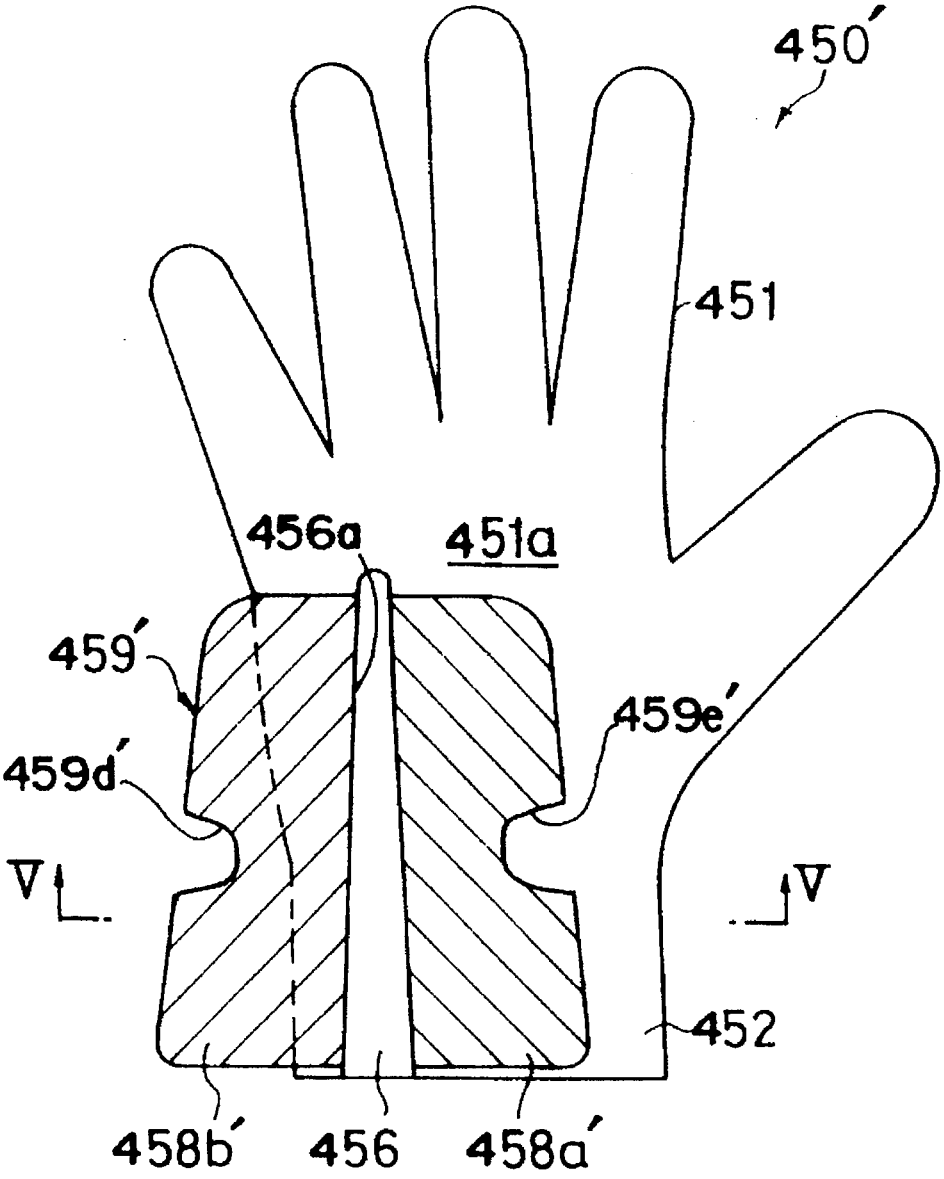
FIG. 32 is a rear view of a modified wrist restraining glove.

A modified wrist restraining glove 450' according to the present invention is shown in FIG. 32. The glove 450' has a similar construction to the glove 450 of FIGS. 30, 31. The only difference is the notches 459*d*' and 459*e*' which are formed on a back restraining flap member 459' and a fastener 458*a*'. Because of the notches 459*d*' and 459*e*', the lateral pivotal movement of the hand around the wrist is easier.

Figure 33:
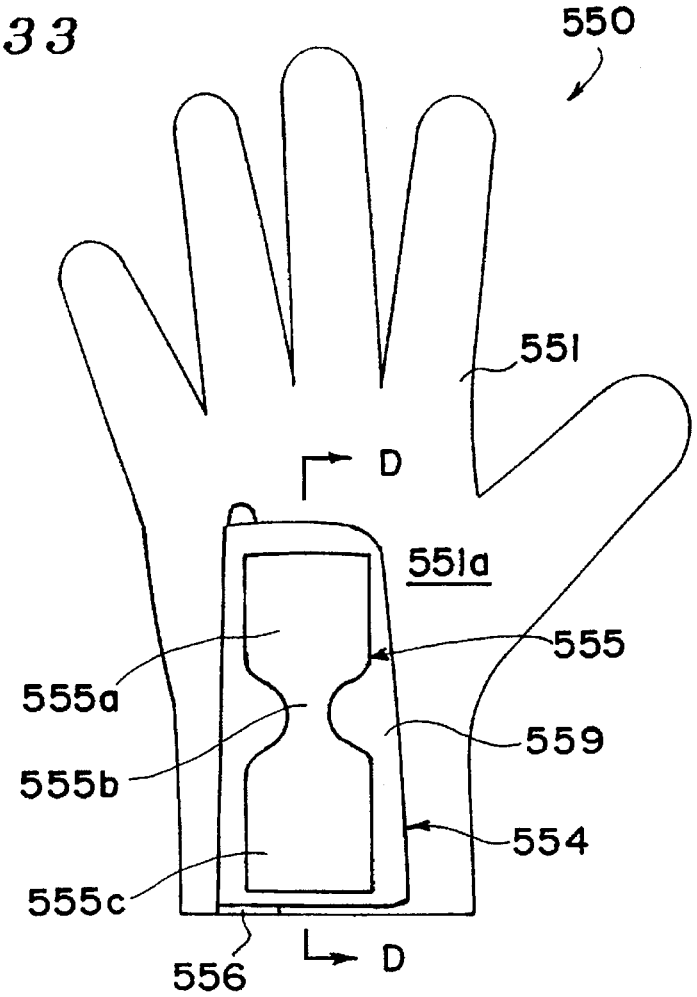
FIG. 33 is a rear view of another modified wrist restraining glove.
Figure 34:
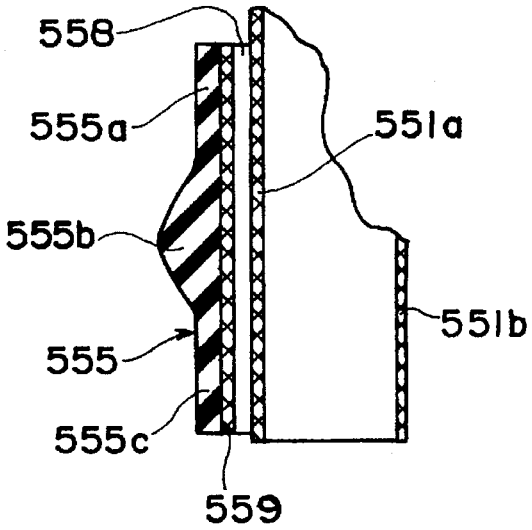
FIG. 34 is a cross-sectional view along the line 34—34 in FIG. 33.

A further modified wrist restraining glove 550 according to the present invention is shown in FIGS. 33 and 34. The glove 650 also has a similar construction to the glove 450 of FIGS. 31, 32. The only difference is in the construction of a back restraining flap member 559 of the wrist restraining glove 550. The back restraining flap member 559 comprises a flap member 559 and a resilient resisting plate 555. A male and a female fasteners 558 such as a loop and hook type fastener are provided on the back surface 551*a* of a hand receiving portion 551 and the inner surface of the flap member 559.

The resilient resisting plate 555 made of elastic material such as rubber, resin etc. is integrally mounted on the outer surface of the flap member 559. The resisting plate 555 has a gourd-shape configuration with a middle narrow portion 555*b*. A knuckle-end portion 555*a* and a wrist-end wide portion 555*c* are wider than the middle portion 555*b*. However, the middle portion 555*b* is thicker than the knuckle-end portion 555*a* and the wrist-end portion 555*c*. Accordingly, the middle portion 555*b* has a large rigidity against being bent outward but has a small rigidity against being bent laterally.

When the hand on which the glove 550 is worn is bent, the middle narrow portion 555*b* is mainly bent. Therefore, the hand is easily bent laterally but is difficult to bend outward.

Figure 35:
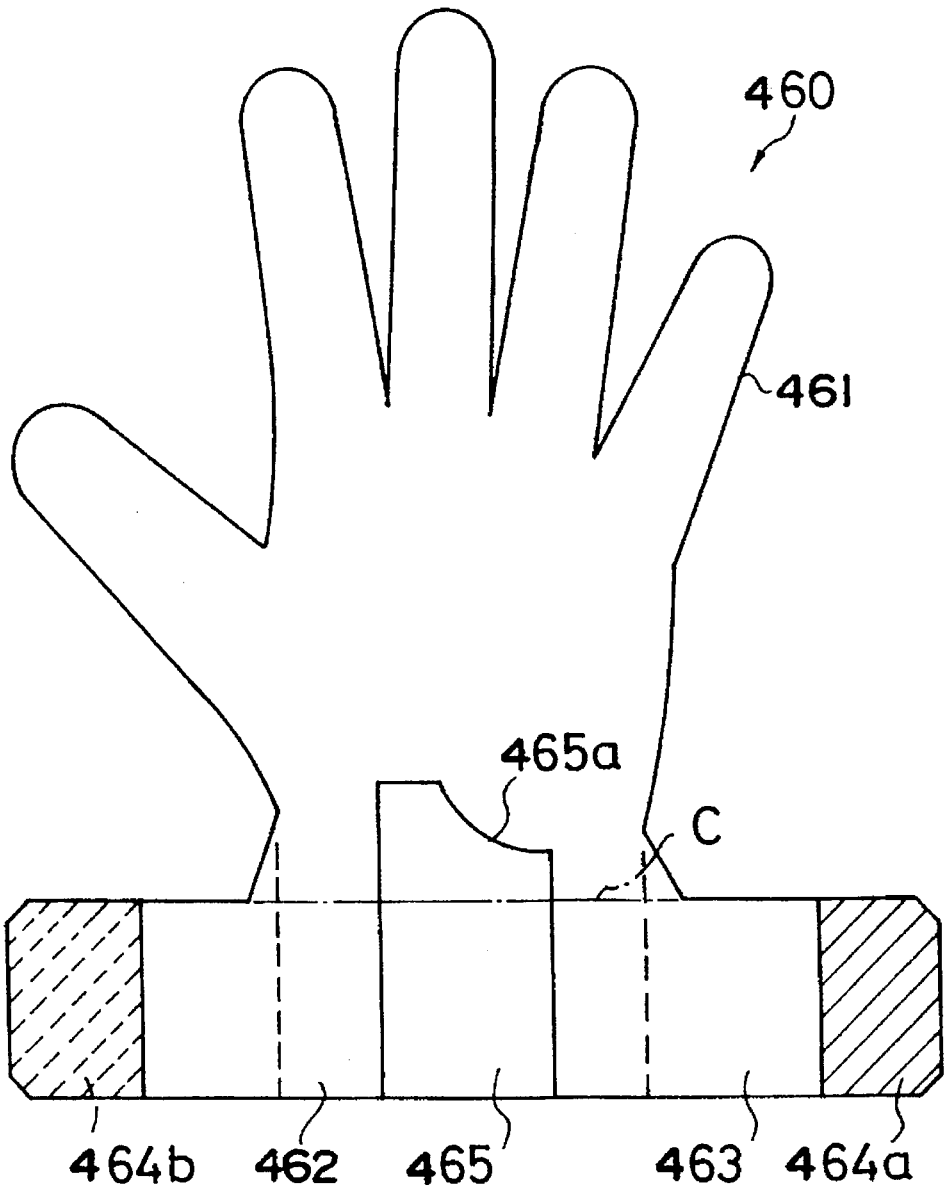
FIG. 35 is a front view of a wrist restraining glove according to the present invention.

A further embodiment of a wrist restraining glove 460 according to the present invention is shown in FIG. 35. The glove 460 comprises a hand receiving portion 461 and a wristlet 462. A band member 463 which has a male and a female fastener 464*a*, 464*b* at the both ends is included in the wristlet 462.

A restraining plate 465 made of resilient material such as rubber, resin etc. is attached on the bottom palmar surface of the glove 460 as shown in FIG. 35.

Figure 36A:
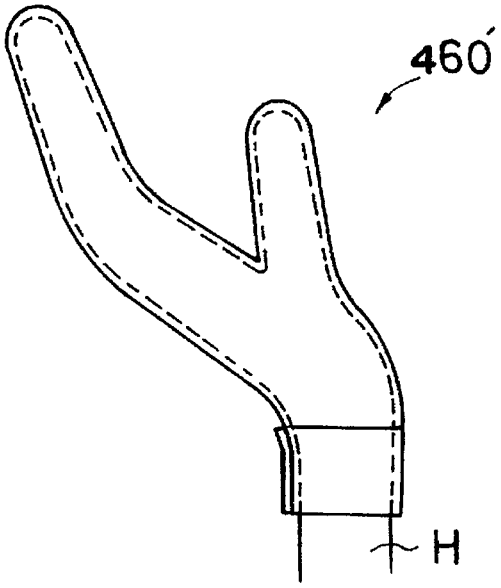
FIGS. 36A and 36B are side views of the glove of FIG. 35.
Figure 36B:
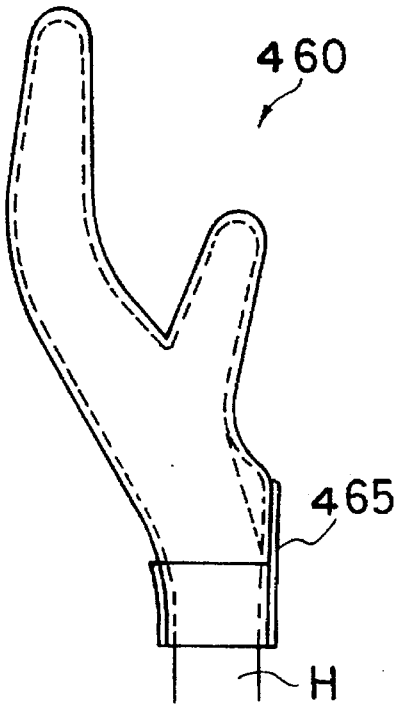

The restraining plate 465 works by suppressing the outward pivotal movement of the hand as shown in FIG. 36B. If the restraining plate 465 is not included in the glove 460, the outward pivotal movement of the hand is permitted almost freely as shown in FIG. 36A. However, the restraining plate 465 resists the outward pivotal movement of the hand by pulling the palmar portion of the glove as shown in FIG. 36B when the hand is bent outward.

The restraining plate 465 has a cut-off portion 465*a* as shown in FIG. 35. Because of the cut-off portion 465*a*, the restraining plate does not interfere with a grip end of a golf club when the golf club is grasped by a hand.

As described above, the wrist restrainer and the wrist restraining glove according to the present invention are suitable for sports, such as golf, baseball, tennis etc., for driving and for physical working. The physical working includes typing or key-board operation of computer.

What is claimed is:

1. A wrist restraining glove comprising:

a hand receiving portion;

a wristlet integrally joined to said hand receiving portion;

a tension member integrally joined with, and fixedly engaged with, a palmar portion of the hand receiving portion and with the wristlet so as to be placed in tension by and to exert a tensile force against outward pivotal movement of the hand about the wrist independently of the fingers.

2. A wrist restraining glove according to claim 1, wherein said tension member is made of resilient material and is elongated on the palmar portion as it extends from the wristlet to the hand receiving portion.

3. A wrist restraining glove according to claim 1, wherein said wristlet has band members having opposite ends provided with interengageable male and female fastening means for keeping said wristlet in firm engagement around the wrist.

4. A wrist restraining glove according to claim 1, wherein at least a part of said wristlet is extensible around the wrist.

5. A wrist restraining glove according to claim 1, wherein the hand receiving portion is fingerless and includes an annular, palm receiving portion from which a wearer's fingers extend in exposed condition.

6. A wrist restraining glove according to claim 1, wherein a longitudinal cut out and a flap member are provided on a back of the hand receiving portion, the flap member being pivotable away from and toward the back of the hand to open and to fasten the longitudinal cut-out in closed condition.

7. A wrist restraining glove according to claim 1, wherein said tension member is provided in a cutout to exert an inward tensile force against an outward pivotal movement of the hand about the wrist.

8. A wrist restraining glove comprising:

a hand receiving portion;

a wristlet integrally joined to said hand receiving portion;

a tension member integrally joined with, and fixedly engaged with, a palmer surface of the hand receiving portion to exert a tensile force against an outward pivotal movement of the hand about the wrist independently of the fingers;

an elongate cut-out formed to extend longitudinally through a back of the hand receiving portion and the wristlet; and a flap member provided on the back of both said hand receiving portion and said wristlet, the flap member being pivotable away from and toward the back of the hand receiving portion to open and to fasten the cut-out closed.

9. A wrist restraining glove according to claim 8, wherein a pocket is formed in the flap member, and a resilient restraining plate made of resilient material is loosely inserted therein to suppress an outward pivotal movement of the hand about the wrist.

10. A wrist restraining glove according to claim 8, wherein a notch is formed medially of the flap member to facilitate a lateral pivotal movement of the hand about the wrist.

11. A wrist restraining glove according to claim 8, wherein a resilient restraining plate made of resilient material is integrally joined to the outer surface of the flap member, said restraining plate having a greater resistance to bending in an outward direction than to bending in a lateral direction, perpendicular to the outward direction.

12. A wrist restraining glove according to claim 11, wherein said restraining plate has a gourd-shape configuration comprising a narrow medial portion interconnecting respective wide portions thereof adjacent the wrist and fingers, respectively.

13. A wrist restraining glove according to claim 12, wherein said medial, narrow portion is thicker than said portions adjacent the wrist and fingers, respectively.

14. A wrist restraining glove according to claim 8, wherein the hand receiving portion is fingerless and includes an annular, palm receiving portion from which a wearer's fingers extend in exposed condition.

15. A wrist restraining glove comprising:

a hand receiving portion;

a wristlet integrally joined to said hand receiving portion; and means for pulling said hand receiving portion inward with respect to said wristlet said means being integrally joined with, and fixedly engaged with, a palmar portion of said hand receiving portion and with said wristlet thereby to resist outward pivotal movement about a wrist of a hand wearing the glove independently of the fingers.

16. A wrist restraining glove according to claim 15, wherein said pulling means include a zip fastener mounted to extend laterally on the hand receiving portion adjacent the wrist band member on a palmar side so that said hand receiving portion will be pulled inward when said zip fastener is closed restricting said outward pivotal movement and whereby said outward pivotal movement will be permitted when said zip fastener is open.

17. A wrist restraining glove according to claim 16, wherein a cut out is formed to extend laterally on the palmar side of the hand receiving portion adjacent the wrist band and said zip fastener is provided on respective opposite edges of the cut out to bring the opposite edges together when the zip fastener is closed.

18. A wrist restraining glove according to claim 15, wherein said wristlet portion includes a band member for firmly wrapping around a wrist.

19. A wrist restraining glove according to claim 15, wherein said means include a hook and loop type fastener mounted to extend laterally on the hand receiving portion adjacent the wrist band member on a palmar side so that said hand receiving portion will be pulled inward when said hook and loop type fastener is closed restricting said outward pivotal movement and whereby said outward pivotal movement will be permitted when said zip fastener is open.

20. A wrist restraining glove according to claim 19, wherein a cut out is formed to extend laterally on the palmar side of the hand receiving portion adjacent the wrist band and said hook and loop type fastener is provided on respective opposite edges of the cut out to bring the opposite edges together when the fastener is closed.

21. A wrist restrainer comprising:

a wristlet;

a finger engaging, retaining member;

a palmar member connecting said wristlet to said retaining member on a palmar side; and a tension member integrally joined with, and fixedly engaged with, said palmar member independently of the finger engaging, retaining member and with said wristlet so as to be placed in tension by and to exert a tensile force against outward pivotal movement of the hand about the wrist independently of the fingers.

22. A wrist restrainer according to claim 21, wherein said wristlet comprises a band member having opposite free ends provided with interengageable male and female fastening means for keeping said band member wrapped firmly around the wrist.

23. A wrist restraining glove according to claim 21, wherein at least a part of said wristlet band is extensible around the wrist.

24. A golf training device worn on a hand comprising a wrist restrainer for restraining pivotal movement of the hand about the wrist comprising a wristlet, a hand engaging portion, and means extending between and linking a palmar side of the wristlet and the hand engaging portion and fixedly engaged therewith with, and arranged to be placed in tension by and apply an inward pulling force to a hand when the hand is pivoted about the wrist in an outward direction thereby to oppose such outward pivotal movement independently of the fingers while permitting pivotal movement of the hand about the wrist in a lateral direction.

25. A golf training device according to claim 24 further comprising:

a cut-out formed to extend laterally between the hand receiving portion and the wristlet on a palmar side;

said means comprising stitching sewing together opposite sides of said cut-out.

26. A wrist restraining glove according to claim 25, wherein the hand engaging portion is fingerless and includes an annular, palm receiving portion from which a wear's fingers extend in exposed condition.

* * * * *